United States Patent [19]

Kiyono et al.

[11] Patent Number: 4,854,283

[45] Date of Patent: Aug. 8, 1989

[54] THROTTLE VALVE CONTROL APPARATUS

[75] Inventors: Masashi Kiyono, Anjo; Kanji Takeuchi, Gamagori; Tomoaki Abe, Obu; Mitsunori Takao, Kariya, all of Japan

[73] Assignee: Nippondenso Co., Ltd., Kariya, Japan

[21] Appl. No.: 126,880

[22] Filed: Nov. 25, 1987

[30] Foreign Application Priority Data

| | | | |
|---|---|---|---|
| Nov. 28, 1986 | [JP] | Japan | 61-284876 |
| Dec. 1, 1986 | [JP] | Japan | 61-286430 |
| Dec. 11, 1986 | [JP] | Japan | 51-295399 |
| Dec. 11, 1986 | [JP] | Japan | 61-295401 |
| Dec. 12, 1986 | [JP] | Japan | 61-297402 |

[51] Int. Cl.[4] ..... F02D 9/02; F02D 41/14

[52] U.S. Cl. ..... 123/361; 123/399

[58] Field of Search ..... 123/352, 361, 399, 403

[56] References Cited

U.S. PATENT DOCUMENTS

| | | | |
|---|---|---|---|
| 4,471,610 | 9/1984 | Watanabe | 123/399 X |
| 4,488,527 | 12/1984 | Pfalzgraf et al. | 123/399 |
| 4,519,360 | 5/1985 | Murakami | 123/399 |
| 4,519,361 | 5/1985 | Murakami | 123/361 X |
| 4,541,378 | 9/1985 | Kitamura | 123/399 X |
| 4,612,615 | 9/1986 | Murakami | 123/361 X |
| 4,640,248 | 2/1987 | Stoltman | 123/399 |
| 4,671,235 | 6/1987 | Hosaka | 123/399 X |
| 4,718,380 | 1/1988 | Katayose et al. | 123/361 X |
| 4,727,838 | 3/1988 | Oshiage et al. | 123/361 |
| 4,745,899 | 5/1988 | Kiuchi et al. | 123/361 X |

FOREIGN PATENT DOCUMENTS

| | | |
|---|---|---|
| 0014834 | 2/1981 | Japan . |
| 0020539 | 2/1984 | Japan . |
| 0119036 | 7/1984 | Japan . |
| 0128934 | 7/1984 | Japan . |
| 0190441 | 10/1984 | Japan . |
| 0173327 | 1/1985 | Japan . |
| 0122549 | 8/1985 | Japan . |
| 0008442 | 1/1986 | Japan . |
| 0023837 | 2/1986 | Japan . |
| 01152933 | 7/1986 | Japan . |

*Primary Examiner*—Willis R. Wolfe

*Attorney, Agent, or Firm*—Cushman, Darby & Cushman

[57] ABSTRACT

A control apparatus for electrically operating a throttle valve adapted to adjust the amount of air drawn into an internal combustion engine to adjust the position of the throttle valve. The position and operating condition of an accelerator pedal are electrically detected to generate a signal in accordance with the accelerator position to drive an actuator adapted to operate the throttle valve, and also a desired throttle position established by the signal, the detected actual position of the throttle valve and the operating condition of the accelerator pedal are suitably compared and examined, thus monitoring to see whether the detection of the accelerator position is not faulty, whether the throttle valve is controlled to follow the desired throttle position and so on and thereby performing a safe control by using a substitute desired position upon occurrence of a faulty condition. Also, during the period of acceleration/deceleration, a driving signal is generated to operate the throttle valve to suit the engine operating condition. Further, when the actuator steps out of synchronism, an evacuation control is performed.

56 Claims, 19 Drawing Sheets

DURING ROTATION IN THROTTLE OPENING DIRECTION

DURING ROTATION IN THROTTLE CLOSING DIRECTION

THROTTLE VALVE CONTROL APPARATUS

BACKGROUND OF THE INVENTION

1. Field of the Invention

This invention relates to an apparatus for electrically controlling the throttle valve installed in an internal combustion engine.

2. Description of the Related Art

In the past, the throttle valve incorporated in any vehicle engine has been connected directly to the accelerator pedal through a link mechanism so that the throttle valve is mechanically actuated to displace its position in accordance with the amount of depression of the accelerator pedal by the driver.

Also, recently the apparatus has been proposed in JP-A-56-14834 in which the accelerator pedal position is detected electrically so that the position of the throttle valve is controlled by an electric actuator, e.g., a motor in accordance with the detected accelerator pedal position.

When installing such an apparatus for electrically controlling the throttle valve position in a vehicle engine, however, the apparatus must be constructed to ensure safe running of the vehicle in view of the absence of any mechanical connection between the accelerator pedal and the throttle valve in contrast to the conventional mechanically-actuated throttle valve.

SUMMARY OF THE INVENTION

It is therefore a first object of the present invention to provide an improved apparatus for electrically controlling a throttle valve.

It is a second object of the invention to provide a throttle valve control apparatus so constructed that a throttle valve is positively actuated in accordance with a command from a control unit for controlling the throttle valve.

It is a third object of the invention to provide a throttle valve control apparatus capable of predicting any danger of failure of an actuator for operating the throttle valve.

It is a fourth object of the invention to provide a throttle valve control apparatus capable of positively and rapidly detecting any faulty condition in a control system and driving system of the throttle valve.

It is a fifth object of the invention to provide a throttle valve control apparatus so designed that when any fault occurs in an actuator for operating the throttle valve, the actuator is prevented from malfunctioning.

It is a sixth object of the invention to provide a throttle valve control apparatus so designed that when any fault occurs in accelerator pedal position detecting means, a minimum vehicle running that meets the driver's will is ensured without using the accelerator pedal position detecting means.

Thus, in accordance with one aspect of the invention there is provided a throttle valve control apparatus including:

a throttle valve for adjusting the amount of air drawn into an internal combustion engine;

throttle valve controlling detecting means for detecting a control parameter for controlling the position of the throttle valve;

a stepping motor for actuating the throttle valve to a given position;

a return spring for applying to the throttle valve a force tending to move it in a closing direction;

throttle valve position commanding means responsive to the control parameter detected by the throttle valve controlling detecting means to generate a command signal for bringing the throttle valve to a given position;

throttle valve acceleration/deceleration detecting means for detecting at least one of an acceleration in the opening direction and deceleration in the closing direction of the throttle valve; and current varying means for increasing a driving current to the stepping motor when the throttle valve acceleration/deceleration detecting means detects at least the acceleration in the opening direction or the deceleration in the closing direction of the throttle valve.

In accordance with another aspect of the invention, there is provided a throttle valve control apparatus including:

a throttle valve for adjusting the amount of air drawn into an engine;

an actuator for operating the throttle valve;

position detecting means for detecting a position of the throttle valve;

command means for applying a command signal to the actuator to operate the throttle valve by the actuator;

monitor means for monitoring a position changing response of the throttle valve due to the command signal from the command means in accordance with the throttle valve position detected by the position detecting means; and fault predicting means responsive to the response of the throttle valve monitored by the monitor means to predict a fault in the operation of the throttle valve.

In accordance with still another aspect of the invention, there is provided a throttle valve control apparatus including:

a throttle valve for adjusting the amount of air drawn into an engine mounted on a vehicle;

an actuator for operating the throttle valve;

position detecting means for detecting an actual position of the throttle valve;

operating condition detecting means for detecting operating conditions of the vehicle and the engine;

position setting means for setting a desired position of the throttle valve in accordance with the operating condition detected by the operating condition detecting means;

driving signal output means for applying a driving signal corresponding to the desired throttle valve position set by the position setting means to the actuator;

deviation computing means for determining a deviation between the actual throttle valve position detected by the position detecting means and the desired throttle valve position set by the position setting means;

integrated value computing means for computing an integrated value over a given time of the deviation determined by the deviation computing means; and decision means for determining the occurrence of a fault when the integrated value determined by the integrated value computing means is greater than a predetermined decision value.

In accordance with still another aspect of the invention, there is provided a throttle valve control apparatus including:

a throttle valve for adjusting the amount of air drawn into an engine;

a stepping motor for operating the throttle valve;

a power source for supplying a current to the stepping motor;

a switch arranged between the stepping motor and the power source to switch on and off the current flow to the stepping motor;

a return spring for biasing the throttle valve in a fully closing direction;

accelerator position detecting means for detecting a position of an accelerator pedal depressed by a driver;

operating condition detecting means for detecting an operating condition of the throttle valve; and computer means responsive to the accelerator pedal position detected by the accelerator position detecting means, the computer means including:

step-out determining means for determining a step-out condition of the stepping motor in accordance with the accelerator pedal position detected by the accelerator position detecting means and the operating condition of the throttle valve detected by the operating condition detecting means; and cut-off commanding means for applying to the switch a command signal for interrupting the current flow to the stepping motor when the step-out determining means determines that the stepping motor has stepped out of synchronism.

In accordance with still another aspect of the invention, there is provided a throttle valve control apparatus including:

a throttle valve for adjusting the amount of air drawn into an engine mounted on a vehicle;

an actuator for operating the throttle valve;

accelerator position detecting means for detecting a position of an accelerator pedal depressed by a driver;

operating condition detecting means for directly detecting an operating condition of the accelerator pedal;

first setting means for setting a desired position of the throttle valve in accordance with the accelerator pedal position detected by the accelerator position detecting means;

driving signal output means for applying to the actuator a driving signal corresponding to the desired throttle position set by the first setting means;

fault detecting means for comparing the accelerator pedal position detected by the accelerator position means and the output from the operating condition detecting means to detect a fault in the accelerator position detecting means; and second setting means for setting another desired position in accordance with the output from the operating condition detecting means when the fault detecting means detects the occurrence of a fault.

DESCRIPTION OF THE PREFERRED EMBODIMENTS

Embodiments of the present invention will now be described in detail with reference to the accompanying drawings.

Figure 1:
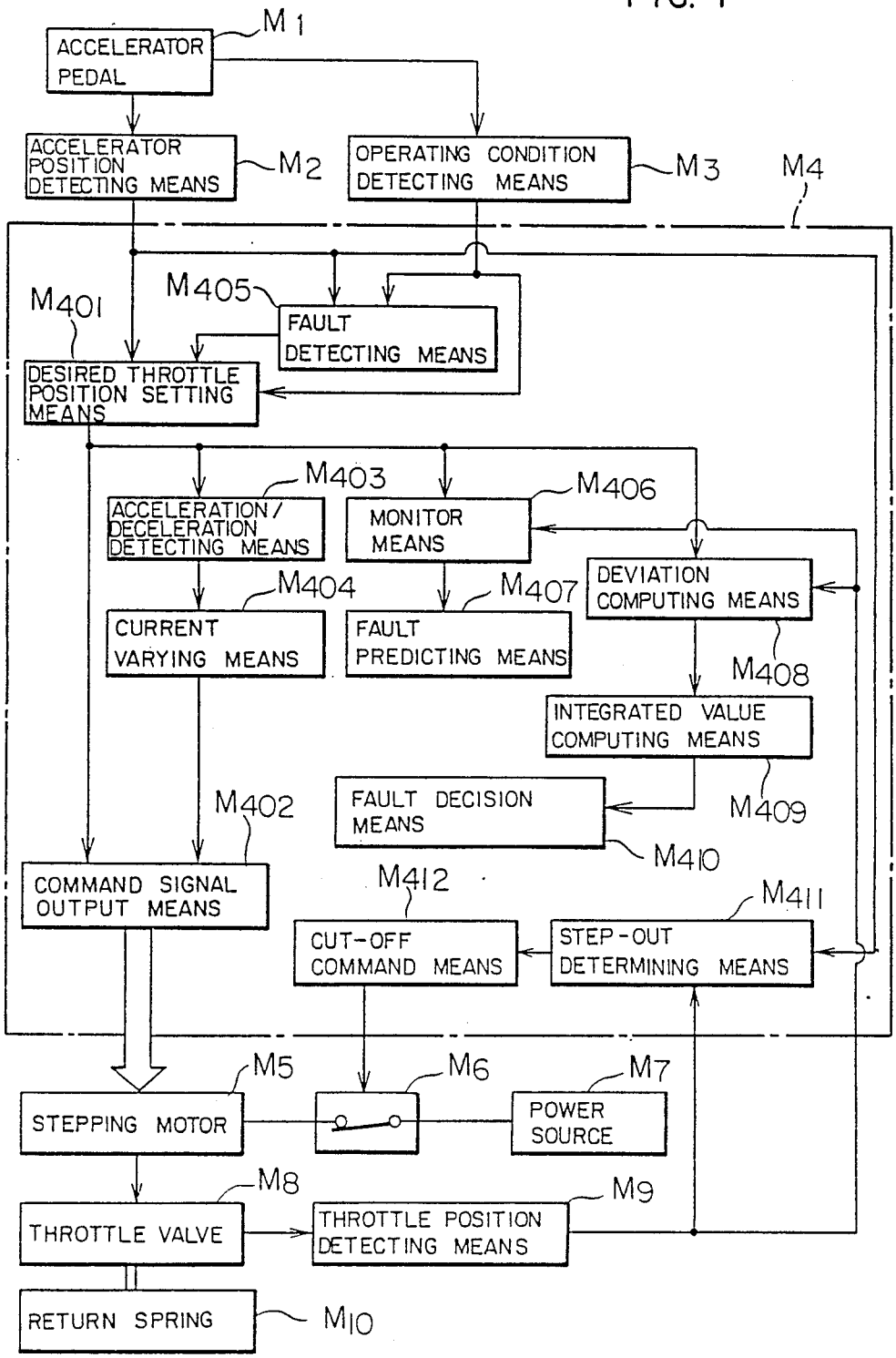
FIG. 1 is a block diagram showing a basic construction of the present invention.

Referring to FIG. 1, there is illustrated a block diagram showing the construction of a throttle valve control apparatus embodying a basic construction of the invention. In the Figure, an accelerator position detecting means $M_2$ detects the position of an accelerator pedal $M_1$ depressed by the driver. Operating condition detecting means $M_3$ detects whether the accelerator pedal $M_1$ is being depressed by the driver. The accelerator pedal position detected by the accelerator position detecting means $M_2$ is applied to desired throttle position setting means $M_{401}$ which in turn sets for a throttle valve $M_8$ a desired position corresponding to the accelerator pedal position. Then, in accordance with the desired throttle position set by the desired throttle position setting means $M_{401}$, command signal output means $M_{402}$ generates a command signal to control the operation of a stepping motor $M_5$. Drive power is supplied to the stepping motor $M_5$ from a power source $M_7$ through a switching element $M_6$ so that in accordance with the command signal from the command signal output means $M_{402}$ the stepping motor $M_5$ operates the throttle valve $M_8$ to the desired position against the force of a return spring $M_{10}$ tending to bias the throttle valve $M_8$ in a closing direction.

The desired throttle position set by the desired throttle position setting means $M_{401}$ is also applied to acceleration/deceleration detecting means $M_{403}$ which in turn detects at least either one of an accelerating condition in the opening direction and a decelerating condition in the closing direction of the throttle valve $M_8$. When either one of the accelerating condition in the opening direction and the decelerating condition in the closing direction of the throttle valve $M_8$ is detected, a signal for increasing the drive current to the stepping motor $M_5$ is applied to the command signal output means $M_{402}$ from current varying means $M_{404}$. Then, in response to a command signal from the command signal output means $M_{402}$, the drive current to the stepping motor $M_5$ is increased in either one of the accelerating condition in the opening direction and the decelerating condition in the closing direction of the throttle valve $M_8$.

It is to be noted that during a accelerating condition in an opening direction and a decelerating condition in a closing direction of a throttle valve, the rotational load applied to a stepping motor is greater than in the other conditions due to the biasing force of a return spring so that if the rotating torque of the stepping motor becomes smaller than the rotational load due to the return spring, the stepping motor steps out of synchronism and the throttle valve is returned to its fully closed position by the return spring. This stepping motor out of synchronism condition will be referred to herein as a step-out condition. While, with a view to solving this problem, it is conceivable to increase the physical body of the stepping motor such that the opening-direction rotating torque of the stepping motor is always held greater than the closing-direction rotational load due to the return spring or to always increase the drive current to the stepping motor. The former attempt has a mounting problem and the latter attempt has a problem of the heat generation of the motor. In the case of the present embodiment, however, the drive current to the stepping motor $M_5$ is increased to increase its rotating torque during at least either the period of acceleration in the opening direction and the period of deceleration in the closing direction of the throttle valve $M_8$ as mentioned previously with the result that there are no mounting and heat generation problems and the stepping motor $M_5$ is prevented from stepping out of synchronism.

On the other hand, fault detecting means $M_{405}$ detects the occurrence of a fault in the accelerator position detecting means $M_2$ in accordance with the outputs of the accelerator position detecting means $M_2$ and the operating condition detecting means $M_3$ so that when such fault is detected, the desired throttle position setting means $M_{401}$ determines a desired throttle position by using the output of the operating condition detecting means $M_3$ in place of the output of the accelerator position detecting means $M_2$.

In this way, it is possible to prevent the danger of a situation arising in which the accelerator position detecting means $M_2$ becomes faulty and a desired throttle valve position is set in accordance with the resulting faulty output thereby causing the throttle valve $M_8$ to stay open even if, for example, the driver releases the depression of the accelerator pedal with intent to bring the vehicle to a stop, and a desired throttle position which conforms to the intention of the driver is set in accordance with the output of the operating condition detecting means $M_3$ thereby ensuring the minimum ordinary safe running of the vehicle.

Also connected to the throttle valve $M_8$ is throttle position detecting means $M_9$ for detecting the actual position of the throttle valve $M_8$ and the thus detected actual throttle position is applied, along with the desired throttle position set by the desired throttle position setting means $M_{401}$, to monitoring means $M_{406}$. The monitoring means $M_{406}$ detects the response speed of the stepping motor $M_5$ in accordance with the applied desired throttle position and the actual throttle position so that fault predicting means $M_{407}$ predicts a faulty condition of the stepping motor $M_5$ in accordance with the response speed detected by the monitoring means $M_{406}$. By so doing, the danger of any fault in the driving system of the throttle valve $M_8$ can be predicted and therefore it is possible to inform the driver of the danger of a situation arising in which the throttle valve $M_8$ is rendered inoperative, that is, the throttle valve $M_8$ is made inoperative due to aging of the bearing portion of the throttle valve $M_8$ or the stepping motor $M_5$ prior to the actual occurrence thereof.

Also, the desired throttle position and the actual throttle position are applied to deviation computing means $M_{408}$ which in turn determines the absolute value of the deviation between the desired throttle position and the actual throttle position. This absolute value is integrated over a given interval of time by integrated value computing means $M_{409}$. Then, the resulting integrated value is compared with a predetermined decision value by fault decision means $M_{410}$ to determine whether the apparatus of this invention is faulty in accordance with the result of the comparison.

By so doing, it is possible to positively detect all kinds of faulty conditions including not only those in which a large deviation is caused between the desired throttle position and the actual throttle position and the deviation continues over a long interval of time but also those in which there is caused a deviation which is not so large but in the steady state, the desired throttle position changes considerably and the actual throttle position fails to follow the desired throttle position or the actual throttle position is caused to hunt considerably for the desired throttle position. Also, since the integrated value reflects the deviation over a given interval of time, the integrated value increases in proportion to the magnitude of the deviation and exceeds the decision value, thus making it possible to rapidly detect a faulty condition.

In addition, the position of the accelerator pedal $M_1$ detected by the accelerator position detecting means $M_2$ and the actual position of the throttle valve $M_8$ detected by the throttle position detecting means $M_9$ are applied to step-out determining means $M_{411}$ included in computer means $M_4$ so that a step-out condition of the stepping motor $M_5$ is detected in accordance with the two input signals. When the step-out condition is detected, cut-off command means $M_{412}$ included in the computer means $M_4$ opens the switching element $M_6$ arranged between the power source $M_7$ and the stepping motor $M_5$.

When this occurs, the current flow to the stepping motor $M_5$ is interrupted thereby preventing any faulty movement of the throttle valve $M_8$ due to the stepping motor $M_5$ malfunctioning after the occurrence of its step-out condition.

In the above-described construction, the desired throttle position setting means $M_{401}$, the command signal output means $M_{402}$, the acceleration/deceleration detecting means $M_{408}$, the current varying means $M_{404}$, the fault detecting means $M_{405}$, the monitoring means $M_{406}$, the fault predicting means $M_{407}$, the deviation computing means $M_{408}$, the integrated value computing means $M_{409}$ and the fault decision means $M_{410}$ are included, along with the step-out determining means $M_{411}$ and the cut-off command means $M_{412}$, in the computer means $M_4$.

Figure 2:
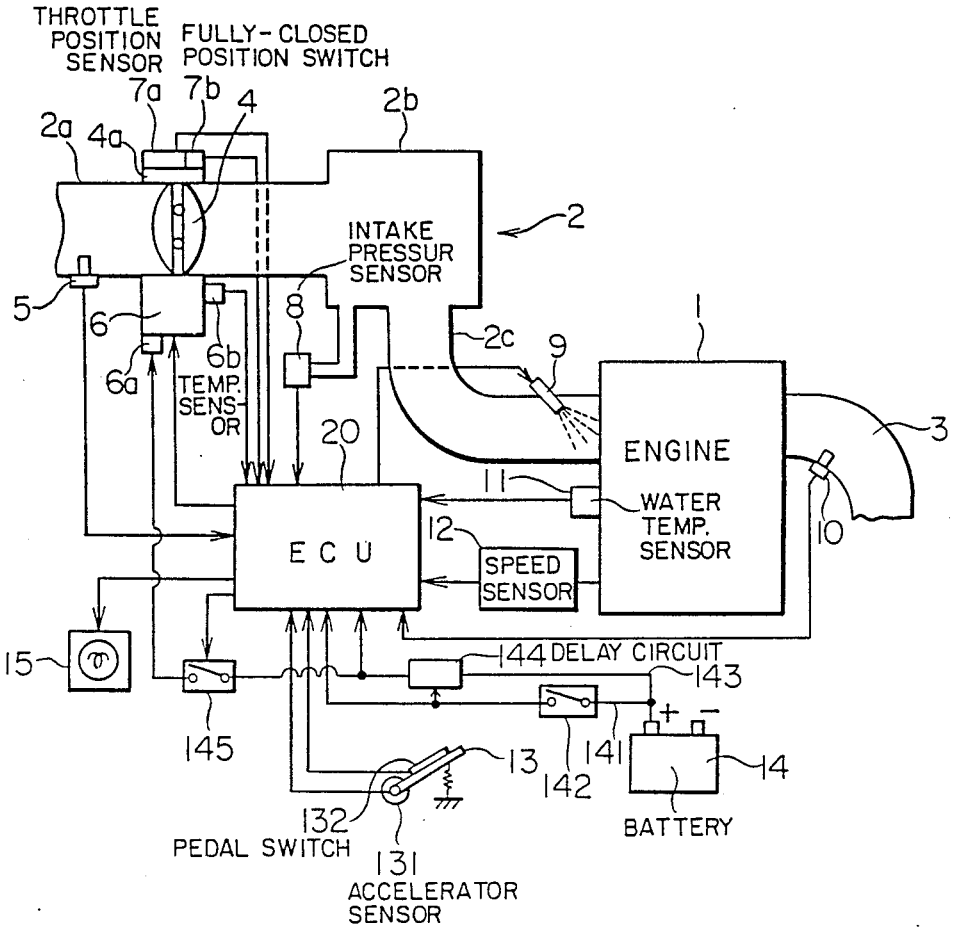
FIG. 2 is a schematic diagram showing an engine equipped with a throttle valve control apparatus according to the invention and its peripheral units.

Referring to FIG. 2 showing the arrangement of an engine incorporating the above-mentioned basic construction and its peripheral units, an engine 1 is a spark ignition-type four cylinder engine mounted on a vehicle, and connected to the engine 1 are an intake pipe 2 and an exhaust pipe 3.

The intake pipe 2 includes an inlet pipe 2*a*, a surge tank 2*b* and branches 2*c* arranged in correspondence to the respective cylinders of the engine 1. An air cleaner (not shown) is positioned in the upstream portion of the inlet pipe 2*a* of the intake pipe 2, and arranged downstream of the air cleaner is a throttle valve 4 for adjusting the amount of air drawn into the engine 1. Also, an intake air temperature sensor 5 for detecting the intake air temperature is arranged between the air cleaner and the throttle valve 4. Mounted on the outer wall of the inlet pipe 2*a* is a stepping motor 6 having a rotor connected to the rotary shaft of the throttle valve 4. Numeral 6*a* designates a connector for connecting the stepping motor 6 to a power source, and 6*b* a temperature sensor for detecting the temperature in the vicinity of the bearing portion (not shown) of the stepping motor 6. Also mounted at the other end of the shaft of the throttle valve 4 are a return spring 4*a* for applying a force tending to bias the throttle valve 4 in a closing direction, a throttle position sensor 7*a* for generating an analog signal corresponding to the position of the throttle valve 4 to detect the throttle position and a fully-closed position switch 7*b* which is turned on when the throttle valve 4 is in the fully closed position.

An intake air pressure sensor 8 is connected to the surge tank 2*b* to detect the intake air pressure therein, and an electromagnetically-operated injector 9 is fitted in each branch 2*c* to inject the fuel into the vicinity of one of intake valves 1*b* of the engine 1.

Fitted into the exhaust pipe 3 is an air-fuel ratio sensor 10 for detecting the air-fuel ratio of the mixture from the residual oxygen content of the exhaust gas.

The engine 1 is provided with a water temperature sensor 11 for detecting the temperature of the cooling water for engine cooling purposes, and a speed sensor 12 for generating pulse signals corresponding to the rotational speed of the engine 1 to detect the engine speed.

Numeral 20 designates an electronic control unit (ECU) whose principal part includes a microcomputer and which is supplied with the engine condition signals from the previously mentioned sensors and applies operation-directing command signals to the stepping motor 6 and the injectors 9, respectively. In addition to these sensors, the ECU 20 receives a voltage signal corresponding to the position of an accelerator pedal 13 depressed by the driver from a potentiometer-type accelerator sensor 131 connected to the accelerator pedal 13, and a signal indicating that the accelerator pedal 13 is being depressed by the driver from a pressure sensitive-type pedal switch 132 mounted on the surface of the accelerator pedal 13 which is treaded on by the driver. The pedal switch 132 is so constructed that the force of its built-in return spring is smaller than the restoring force of the accelerator pedal 13 itself and therefore it is always turned on when the driver applies a force by the foot to apply the force corresponding to any amount of pedal depression other than a zero depression.

Numeral 14 designates a battery forming a power source for supplying power to the ECU 20, the stepping motor 6, etc. Also, arranged in a current supply line 141 leading from the battery 14 to the ECU 20 is a key switch 142 which is operated by the driver and a delay circuit 144 is arranged in a current supply line 143 connected in parallel with the current supply line 141. The delay circuit 144 is constructed so that it is triggered into operation by the turning on of the key switch 142 and it comes out of operation at the expiration of a given time (about 3 sec) after the turning off of the key switch 142. Therefore, the ECU 20 is supplied with the power from the battery 14 for the given time even after the turning off of the key switch 142. The current supply line 143 is also connected to the connector 6*a* of the stepping motor 6, and a service-type relay 145 adapted to be opened by a signal from the ECU 20 is arranged in the rear of the portions of the current supply line 143 which branch to the ECU 20 and the stepping motor 6.

Numeral 15 designates a warning lamp mounted on the meter panel (not shown) in the driver's seat and it is turned on by the ECU 20.

Figure 3:
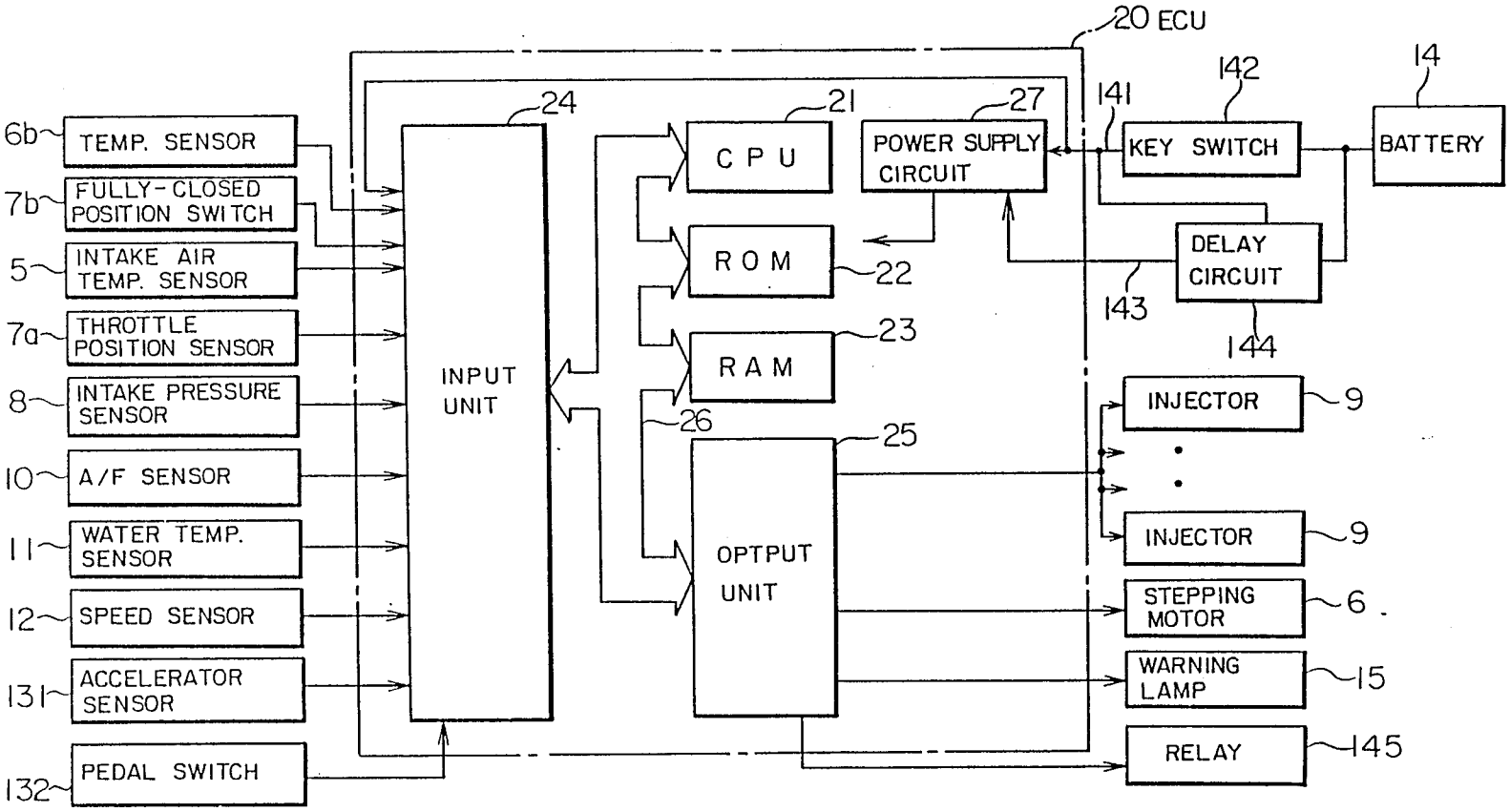
FIG. 3 is a block diagram showing the construction of the electronic control unit shown in FIG. 2.

Referring now to FIG. 3, there are illustrated the principal components of the ECU 20. Numeral 21 designates a CPU (central processing unit) for computing the desired valve opening time for the injectors 9 and the desired amount of movement for the stepping motor 6 in accordance with the signals from the previously mentioned sensors, etc., and for detecting any fault in the driving system and the control system for the throttle valve 4 to command the required measure to deal with the occurrence of the fault. Numeral 22 designates a read-only memory or ROM storing the necessary constants, data, etc., used in the processing by the CPU 21, and 23 a read/write memory or RAM for temporarily storing the results of operations in the CPU 21, the detected data from the sensors, etc. The RAM 23 is constructed so that its stored contents are maintained even if the power supply to the ECU 20 is stopped. Numeral 24 designates an input unit for receiving the signals from the sensors to perform the necessary signal processing operations, e.g., A/D conversion and waveform reshaping on the signals. Numeral 25 designates an output unit responsive to the results of operations performed in the CPU 21 to output signals for operating the injectors 9 and the stepping motor 6 as well as signals for operating the warning lamp 15 and opening the relay 145. Numeral 26 designates a common bus for interconnecting the CPU 21, the ROM 22, the RAM 23, the input unit 24 and the output unit 25 for the mutual transmission of data. Numeral 27 designates a power supply circuit connected to the current supply lines 141 and 143 of which the current supply line 141 is connected to the battery 14 through the key switch 142 and the current supply line 143 is connected to the battery 14 through the delay circuit 144, thereby supplying the power to the CPU 21, the ROM 22, the RAM 23, the input unit 24 and the output unit 25 from the power supply circuit 27.

Figure 4:
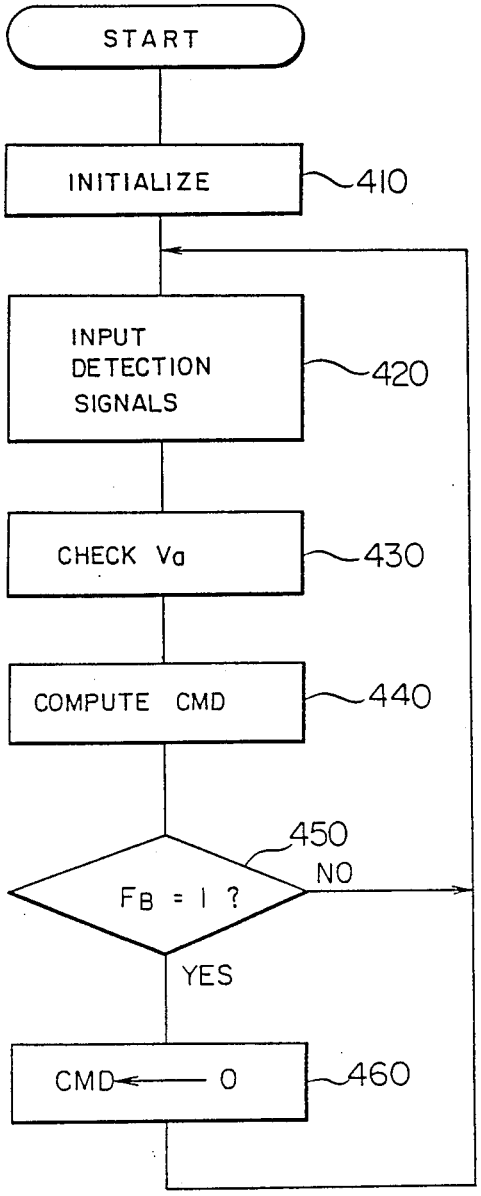
FIG. 4 is a flow chart showing a procedure for computing a desired position or command value CMD for the throttle valve.

Referring to FIG. 4, there is illustrated a flow chart of a program which is executed as a main routine by the CPU 21, particularly extracting only a portion of the program to show an example of a control program for the throttle valve 4.

In FIG. 4, when the key switch 142 is closed thereby supplying the power to the ECU 20, the processing of the main routine is started so that the data at given addresses in the RAM 23, the input unit 24 and the output unit 25 are initialized first at a step 410.

At a step 420, the signals detected by the previously mentioned sensors are inputted. At a step 430, the voltage signal $V_a$ inputted at the step 420 and indicating the accelerator pedal position is checked so that when the occurrence of a fault is determined, a substitute value is computed. At a step 440, a basic desired throttle position $\theta_{so}$ for the throttle valve 4 is read from the basic desired throttle position map stored in the ROM 22 in accordance with the accelerator sensor signal $V_a$ and also correction values are determined in accordance with the other input signals to correct the basic desired throttle position $\theta_{so}$ according to the correction values and thereby compute the current desired throttle position or command value CMD. At the next step 450, it is determined whether a flag $F_B$ set in the RAM 23 by a fault determination process in accordance with the operating condition of the throttle valve 4 as will be mentioned later is 0 (proper) or 1 (faulty). If the flag $F_B$ is 0, a return is made to the step 420. If it is 1, the command value CMD is set to 0 and a return is made the step 420.

The detailed operations of the step 430 in FIG. 4 will now be described with reference to FIGS. 5 and 6.

Figure 5:
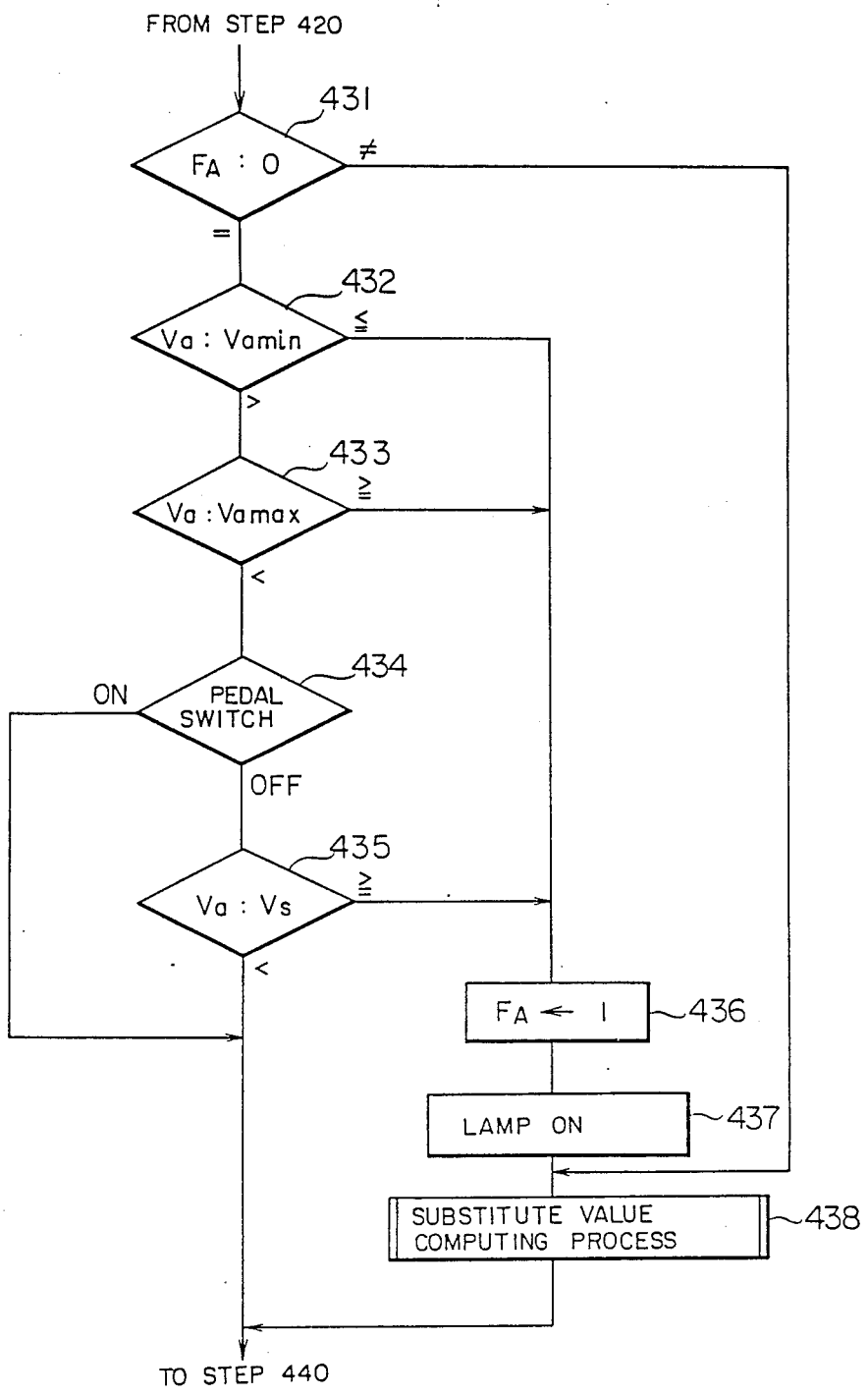
FIG. 5 is a flow chart showing the detailed procedure of the step 430 in the flow chart shown in FIG. 4.

In FIG. 5, at a step 431, it is determined whether a flag $F_A$ stored in the RAM 23 to indicate a faulty condition of the accelerator sensor 131 is 0. It is to be noted that $F_A=0$ indicates that the accelerator sensor 131 is functioning properly and $F_A=1$ indicates that the accelerator sensor 131 is faulty. Therefore, if $F_A=0$, a transfer is made to a step 432. If $F_A \neq 0$, a transfer is made to a step 438. At the steps 432 and 433, the voltage signal $V_a$ from the accelerator sensor 131 is compared with a lower limit value $V_{amin}$ and upper limit value $V_{amax}$ of the normal output to determine whether it is within the given range. If it shows a voltage value greater than the given range, it is determined that there is a break in the connection between the accelerator sensor 131 and the ground. If it shows a smaller voltage value than the given range, it is determined that there is a break in the voltage supply line. Thus, a transfer is made to a step 436. If the signal from the accelerator pedal 131 is within the given range, a transfer is made to a step 434 where it is determined whether the pedal switch 132 is ON or OFF. If it is OFF, a transfer is made to a step 435 where the accelerator sensor signal $V_a$ is compared with a maximum voltage value $V_s$ of the accelerator sensor 131 which is attainable in the OFF condition of the pedal switch 132. If $V_a<V_s$, it is determined that the accelerator sensor 131 is functioning properly and the processing is completed, thereby making a transfer to the step 440. If it is not the case, it is determined that the accelerator sensor 131 is faulty and thus a transfer is made to a step 436. At the step 436, the $F_A$ is set to 1 and a transfer is made to a step 437 where a command is applied to the output unit 25 to turn the warning lamp 15 on. Then, a substitute value computing processing is performed at the step 438. Here, a substitute value for $V_a$ is determined only on the basis of the ON or OFF state signal of the pedal switch 132 and it is sent for use in the operations of the step 440 and the following which are to be performed next.

Figure 6:
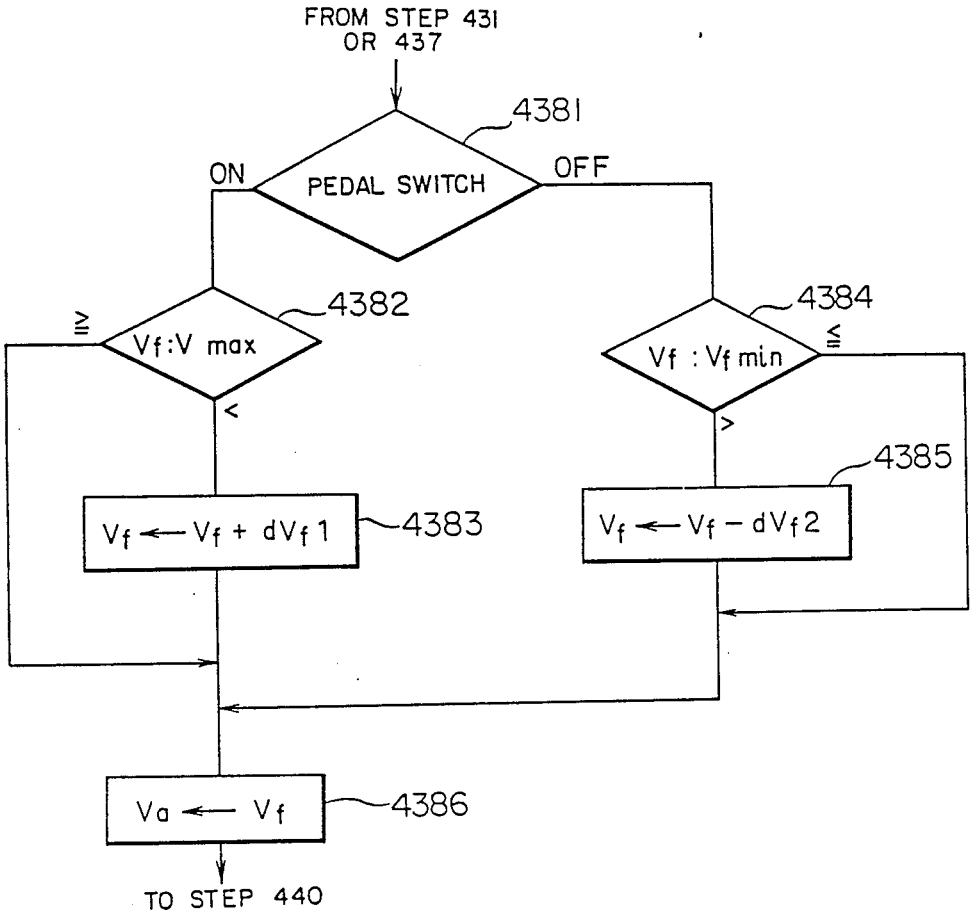
FIG. 6 is a flow chart showing the detailed procedure of the step 438 in the flow chart shown in FIG. 5.

In the substitute value computing processing shown in FIG. 6, at a step 4381, it is determined whether the pedal switch 132 is ON or OFF. If it is ON, a transfer is made to a step 4382 where an accelerator position substitute value $V_f$ is compared with its maximum value $V_{fmax}$. If the substitute value $V_f$ is smaller than the maximum value $V_{fmax}$, a transfer is made to the next step 4383. If it is not the case, the step 4383 is skipped and a transfer is made to a step 4386. At the step 4383, the addition of $dV_{f1}$ to the substitute value $V_f$ is effected and a transfer is made to the step 4386. On the contrary, if the pedal switch 132 is OFF, a transfer is made to a step 4384 where the substitute value $V_f$ is compared with a minimum value $V_{fmin}$ corresponding to the accelerator position 0. If $V_f>V_{fmin}$, a transfer is made to a step 4385. If it is not, the step 4385 is skipped and a transfer is made to the step 4386. At the step 4385, the value of $dV_{f2}$ ($dV_{f2}>dV_{f1}$) is subtracted from the substitute value $V_f$. Finally, at the step 4386, the accelerator sensor signal $V_a$ is replaced with the substitute value $V_f$ and the processing is completed, thereby making a transfer to the step 440. It is to be noted that when the ECU 20 is connected to the power source, the minimum value $V_{fmin}$ is provided as the substitute value $V_f$.

Figure 7:
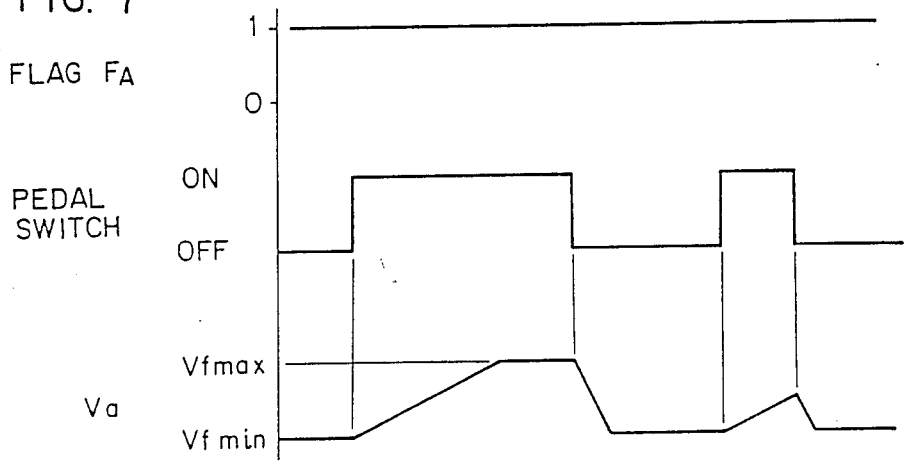
FIG. 7 is a time chart showing the variation of an accelerator sensor signal Va according to the flow chart shown in FIG. 6.

In this way, when the flag $F_A$ is 1, the accelerator sensor signal $V_a$ is varied in response to the ON-OFF operations of the pedal switch 132 as shown in FIG. 7 so that the corresponding command value CMD to the accelerator sensor signal $V_a$ is determined by the processing of the step 440 of FIG. 4 and therefore the stepping motor 6 is operated by a stepping motor driving program which will be described later, thus adjusting the throttle valve 4 into a given position and thereby allowing the vehicle to make an evacuation running. It is to be noted that by establishing $dV_{f1}<dV_{f2}$, the accelerator sensor signal $V_a$ is caused to increase gradually when the pedal switch 132 is ON and it is caused to decrease rapidly when the pedal switch 132 is OFF.

With the construction described above, the signal from the pedal switch 132 is compared with the voltage signal from the accelerator sensor 131 to determine the occurrence of a fault in the accelerator sensor 131. In other words, where the accelerator sensor signal has some value due to a fault in the accelerator sensor 131 despite the fact that the accelerator pedal 13 is not depressed, in accordance with the prior art techniques the position of the throttle valve 4 is adjusted in accordance with this faulty value, whereas in accordance with the construction of the embodiment the signal from the pedal switch 132 is inputted so that it is possible to detect that the accelerator pedal 13 is in fact not depressed and therefore any fault in the accelerator sensor 131 can be easily determined, thereby preventing the throttle valve 4 from being opened erroneously.

Also, since the pedal switch 132 is designed so that it is turned on when the accelerator pedal 13 is depressed by the driver, even if a break is caused in the connection leading to the pedal switch 132, a signal indicative of the accelerator pedal 13 being not depressed is generated, thereby preventing the occurrence of any dangerous situation.

Also, when it is determined that the accelerator sensor 131 is faulty, the output of the pedal switch 132 is utilized as a signal reflecting the will of the driver and a substitute value $V_f$ is computed to use it as the acceleration sensor signal $V_a$. Then, the accelerator sensor signal $V_a$ is increased gradually during the ON period of the pedal switch 132, whereas when the pedal switch 132 is turned OFF, the accelerator sensor signal $V_a$ is decreased at a rate greater than the rate at which it is increased. As a result, the throttle valve 4 is opened and closed in response to the rates of increase and decrease in the accelerator sensor signal $V_a$ and this allows the driver to make an evacuation running. Note that in such a case, the upper limit value is established for the substitute value $V_f$ so as to prevent the throttle valve 4 from being opened excessively and therefore the vehicle speed is prevented from increasing excessively during the evacuation running. In addition, due to the fact that the accelerator sensor signal $V_a$ in the form of the substitute value $V_f$ is designed to increase gradually but decrease rapidly, as mentioned previously, the throttle valve 4 is opened gradually and closed at a rate faster than the opening rate, thereby ensuring a safe evacuation running.

Figure 8A:
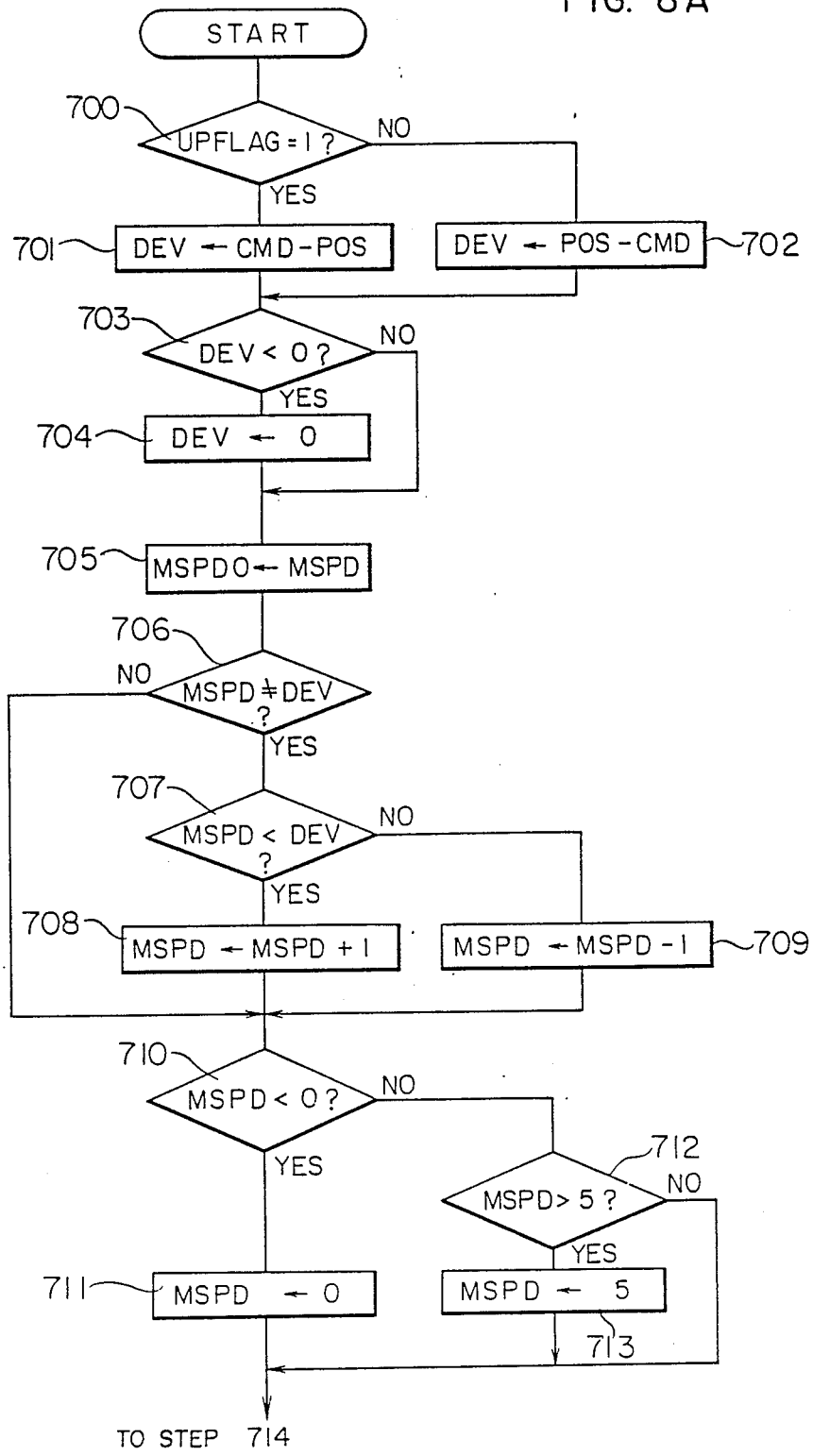
FIGS. 8A and 8B show a flow chart illustrating the procedures for driving the stepping motor in accordance with the command value CMD determined by the flow chart shown in FIG. 4.
Figure 8B:
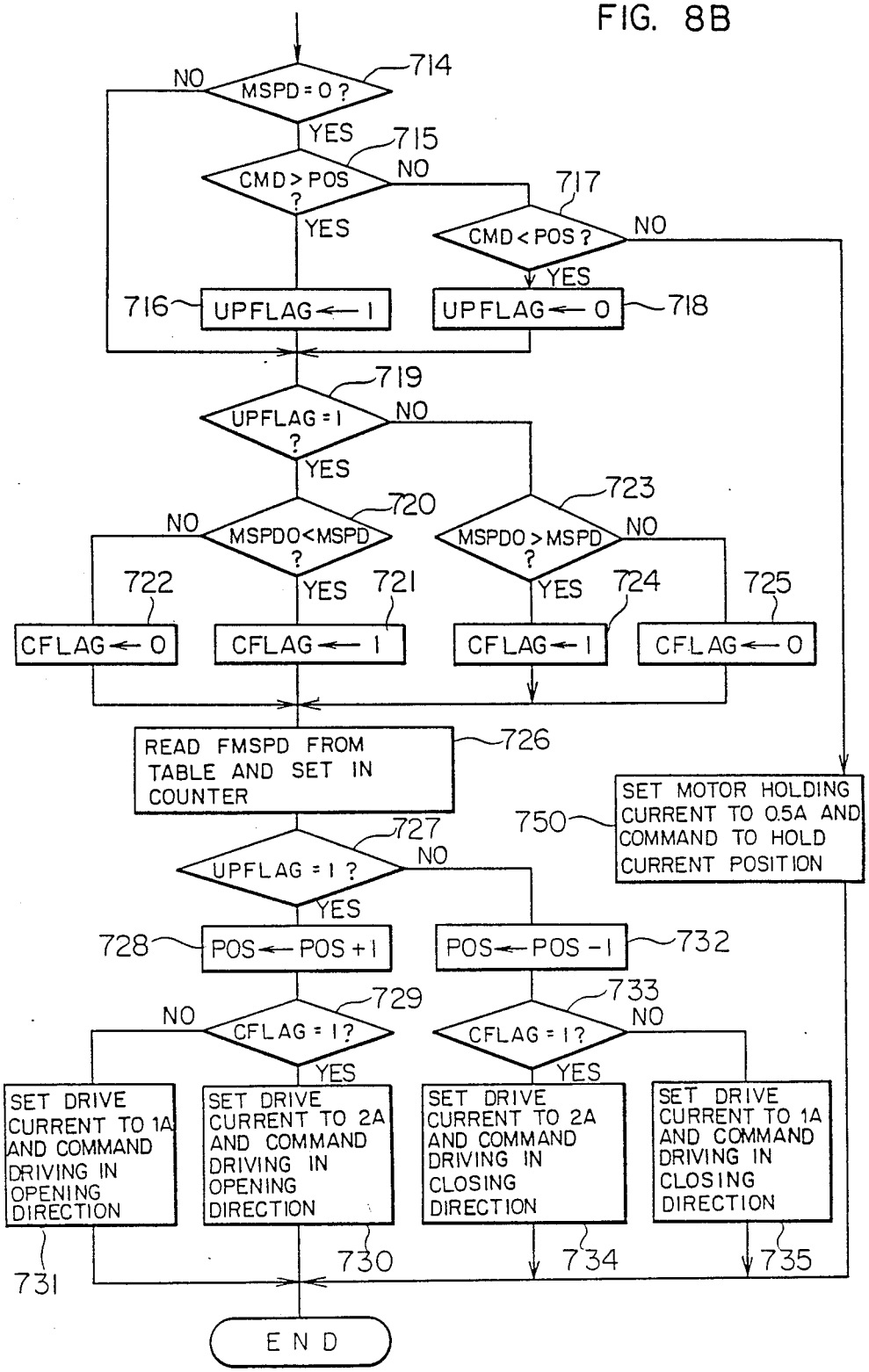

Referring to FIGS. 8A and 8B, there are illustrated a flow chart of a program for driving the stepping motor 6 in accordance with the command value CMD determined at the step 440 of FIG. 4, and the program is executed at intervals of a time determined by the then existing pulse rate (See a step 726).

At a step 700, a flag UPFLA indicative of the current direction of rotation of the stepping motor 6 ("1" corresponds to the up or throttle valve opening direction and "0" corresponds to the down or closing direction) is checked. Note that the UPFLAG is initialized and set to "1" in response to the fully closed throttle position. At steps 701 and 702, the deviation DEV between the throttle valve position command value CMD and the actual value POS is determined. With the stepping motor 6, since the actual value POS follows the command value CMD with a certain delay, the order of subtraction are made to differ between the up and down directions to handle the deviation DEV as an absolute value. It is to be noted that the actual value POS is not a value obtained from the throttle position sensor 7a and it is the value of a counter which is incremented when the stepping motor 6 is moved in a direction tending to open the throttle valve 4 according to the present processing and which is decremented when the stepping motor 6 is moved in the other direction tending to close the throttle valve 4. At steps 703 and 704, the deviation DEV is set to 0 when it becomes negative for some reasons or other. At a step 705, the value of MSPD obtained as the result of the preceding execution of the present routine is stored as MSPDO. At a step 706, it is determined whether the speed control parameter MSPD ($0 \leqq MSPD \leqq 5$) (See Table 1 shown later The value of MSPD determines the interval of time up to the next interruption or the pulse rate. See the step 726.) is equal to the present deviation DEV. If the equality is found, the MPSD is not changed and a transfer is made to a step 710. If the equality is not found, the two are compared in magnitude at a step 707 so that if DEV>MSPD, a transfer is made to a step 708 and the value of MSPD is incremented. If DEV<MSPD, a transfer is made to a step 709 and the value of MSPD is decremented. In other words, when the deviation DEV is greater, the interval of time for the execution of the present interrupt routine is decreased for acceleration, whereas when the deviation DEV is smaller, the interval of time for the execution of the interrupt routine is increased for deceleration. Steps 710 to 713 are steps for bringing the value of MSPD within a range from 0 to 5.

In this case, whether the drive command applied to the stepping motor 6 is in the up direction or the down direction is determined by the flag UPFLAG. Assuming now that with the stepping motor 6 being rotated in the up direction, if the command value CMD is changed so that a down-direction drive command is applied to the stepping motor 6, the stepping motor 6 is not capable of rapidly changing the direction of rotation due to its inertia and it steps out of synchronism. As a result, the direction of rotation must be changed after the motor speed has been slowed down sufficiently. Thus, it is designed so that the flag UPFLAG cannot change its state until MSPD=0 results. These operations are performed at steps 714 to 718. At the step 714, it is determined whether MSPD=0 or not. If it is not, the flag UPFLAG is not renewed and a transfer is made to a step 719. If MSPD=1 and CMD>POS, the stepping motor 6 must be rotated in the direction tending to open the throttle valve 4 and the flag UPFLAG is set to 1 (steps 715 and 716). If MSPD=0 and CMD<POS, the stepping motor 6 must be rotated in the throttle closing direction and the flag UPFLAG is set to 0 (steps 717 and 718) If the step 717 goes to NO, that is, CMD=POS, it is not necessary to send a drive command to the stepping motor 6 so that at a step 750, the holding current is set to 0.5 A and a command is sent to the stepping motor 6 to maintain the current position, thereby ending the present program temporarily.

Then, at the step 719, the flag UPFLAG is checked so that a transfer is made to a step 720 when the throttle opening direction is indicated (UPFLAG=1) and a transfer is made to a step 723 when the throttle closing direction is indicated (UPFLAG=0). At the step 720, the MSPDO or the MSPD obtained by the preceding execution of this routine and the current MSPD are compared in magnitude so that if MSPDO<MSPD, that is, if the stepping motor 6 is accelerated while rotating in the opening direction of the throttle valve 4, a transfer is made to a step 721 and a flag CFLAG indicative of increasing the current for driving the stepping motor is set to 1. In other conditions than the acceleration condition, a transfer is made to a step 722 and the flag CFLAG is set to 0. Steps 723 to 725 are similar so that the flag CFLAG is set to 1 when the stepping motor 6 is decelerated during its rotation in the closing direction of the throttle valve 4. In other conditions, the flag CFLAG is set to 0. At the next step 726, a time interval FMSPD up to the next interrupt is read from Table 1 in accordance with the MSPD and it is set in a counter.

TABLE 1

| MSPD | 0 | 1 | 2 | 3 | 4 | 5 |
|---|---|---|---|---|---|---|
| FMSPD (μs) | 2000 | 1234 | 952 | 800 | 704 | 633 |

At a step 727, the flag UPFLAG is again checked so that if the rotation is in the throttle opening direction, a transfer is made to a step 728 where the value of POS is incremented. At the next step 729, the flag CFLAG is checked so that if CFLAG=1 or the acceleration during the rotation in the opening direction of the throttle valve 4, a transfer is made to a step 730 where the motor driving current is set to a large current [2A] and a throttle opening drive command is generated, thereby rotating the stepping motor 6 in the direction tending to open the throttle valve 4. If CFLAG=0 or the other condition than the acceleration during the rotation in the opening direction of the throttle valve 4, a transfer is made to a step 731 where the driving current is set to a small current [1A] and a throttle opening command signal is generated, thereby rotating the stepping motor 6 in the direction tending to open the throttle valve 4. In the case of rotation in the throttle closing direction, the similar operations are performed so that during the period of deceleration the driving current to the stepping motor 6 is set to a greater value than in the other conditions and a throttle closing drive command is generated (steps 732 to 735).

Thus the present program is ended temporarily.

Figure 9:
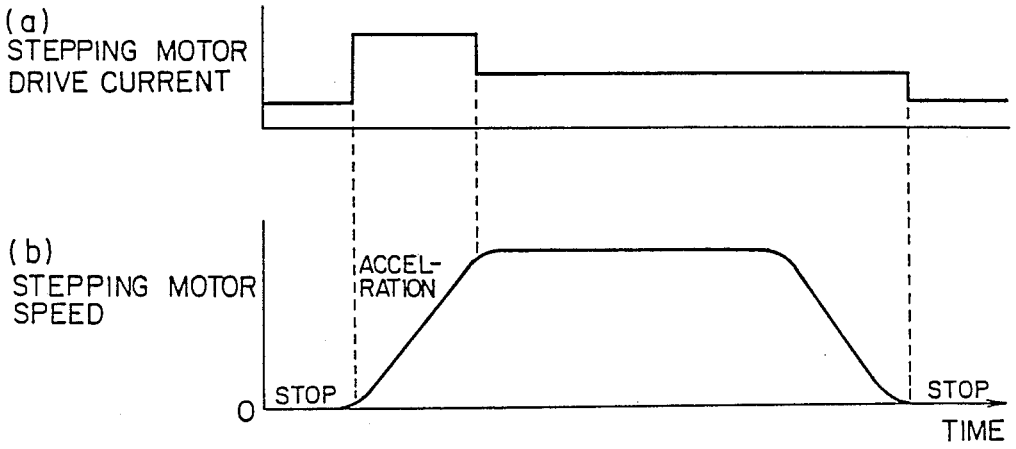
FIG. 9 is a waveform diagram showing the variation of a stepping motor driving current during the rotation of the throttle valve in the opening direction and a characteristic diagram showing the variation of the stepping motor rotational speed.
Figure 10:
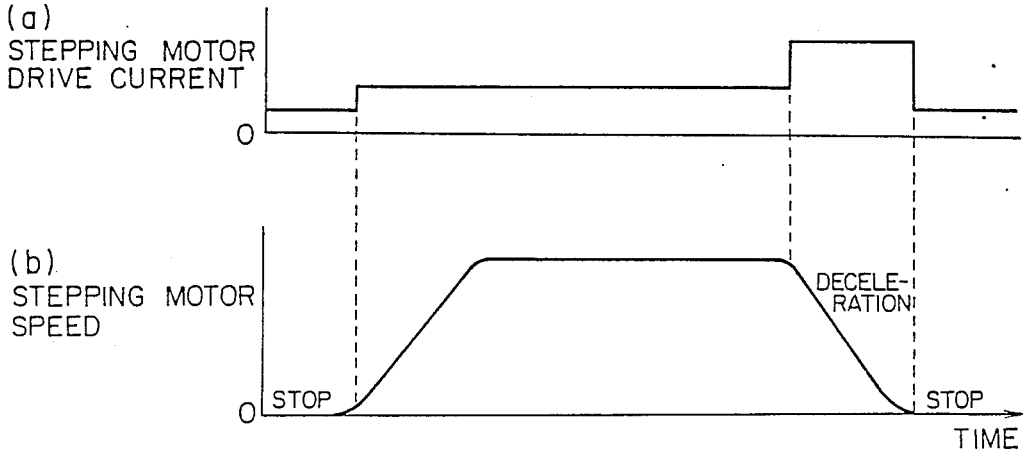
FIG. 10 is a waveform diagram showing the variation of a stepping motor driving current during the rotation of the throttle valve in the closing direction and a characteristic diagram showing the variation of the stepping motor rotational speed.

Referring now to FIG. 9, shown in (a) is the manner in which the driving current to the stepping motor 6 is varied during the rotation in the throttle opening direction under the above-mentioned control, and shown in (b) is the manner in which the rotational speed of the stepping motor 6 is varied in correspondence to the driving current variation in (a). Also, shown in (a) of FIG. 10 is the manner in which the driving current to the stepping motor 6 is varied during the rotation in the throttle closing direction, and shown in (b) of FIG. 10 is the corresponding manner in which the rotational speed of the stepping motor 6 is varied.

As the result of the above-mentioned processing, the stepping motor 6 drives the throttle valve 4 into rotation in accordance with a driving command signal so that the throttle valve 4 is adjusted to the optimum position which is determined by an accelerator sensor signal $V_a$ and various engine parameters.

Particularly, in accordance with the above-processing, when the rotating torque of the stepping motor 6 must be increased by the return spring 4*a*, that is, only during the period of acceleration in the opening direction of the throttle valve 4 or the period of deceleration in the closing direction of the throttle valve 4, the driving current to the stepping motor 6 is increased than in the other conditions so that the problems of mounting and heat generation are eliminated and a step-out condition of the stepping motor 6 is prevented effectively.

In addition, the desired injection time of the injectors 9 is determined by the CPU 21 by use of the conventional means so that the injector 9 is driven by a pulse-type drive signal corresponding to the injection time and applied from the output unit 25 and the desired amount of fuel is injected into the branch 2*c*.

Figure 11:
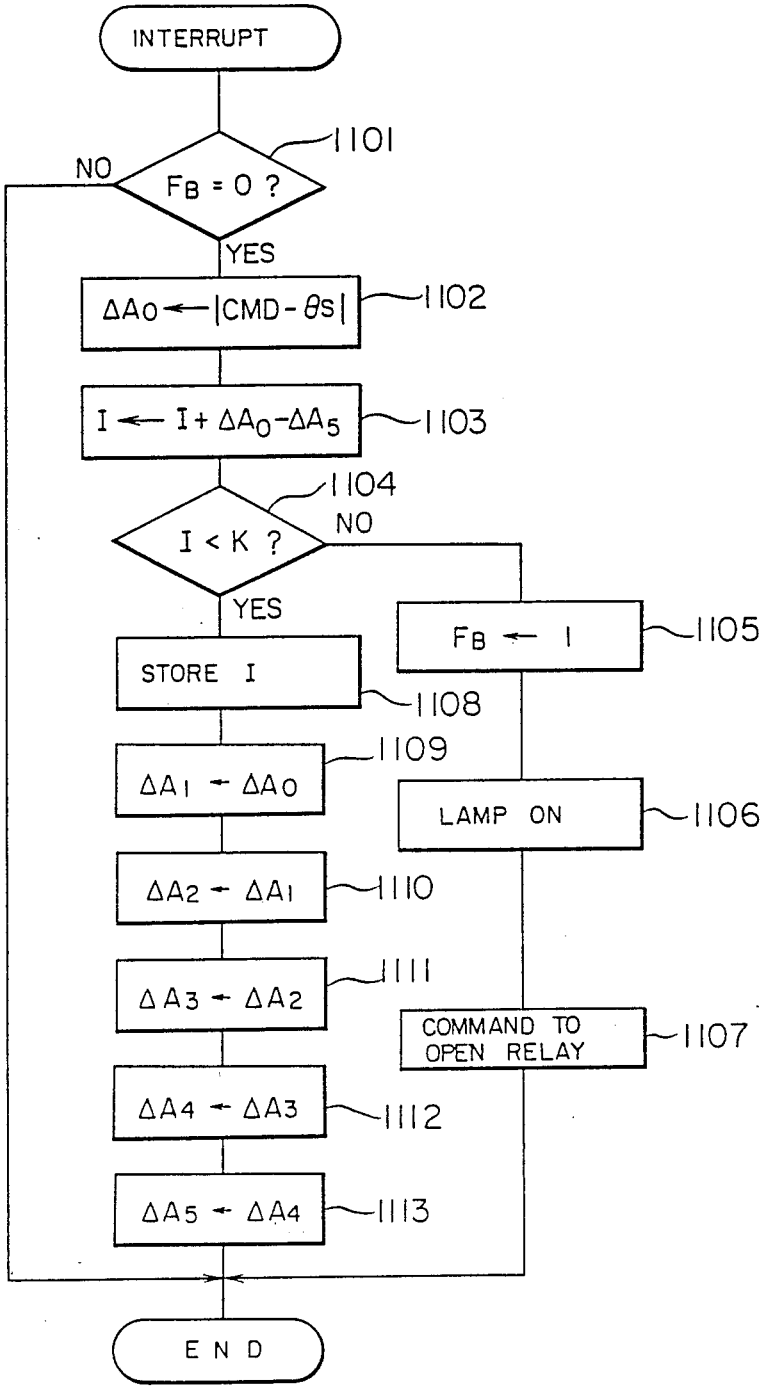
FIG. 11 is a flow chart showing a procedure for detecting malfunctioning of the apparatus according to the invention.

Referring to FIG. 11, there is illustrated a flow chart of a program for determining a fault in the operating condition of the throttle valve 4 and for effecting the setting of the previously mentioned flag $F_B$ and it is executed as an interruption routine at intervals of 50 ms, for example.

Figure 12:
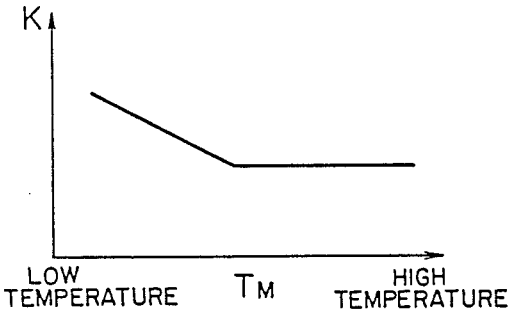
FIG. 12 is a characteristic diagram showing the relation between a decision value K and a motor temperature $T_M$.

Firstly, at a step 1101, a check is made on the basis of the flag $F_B$ to determine whether the presence of a fault in the operating condition of the throttle valve 4 has been determined by the previous processing of this routine. If the flag $F_B$ is 1, the routine is ended. If the flag $F_B$ is 0, a transfer is made to a step 1102. At the step 1102, the absolute value of the deviation between the command value CMD of the throttle valve 4 determined by the processing routine of FIG. 4 and the actual throttle position $\theta_s$ of the throttle valve 4 detected by the throttle position sensor 7*a* and it is designated as $\Delta A_0$. At the next step 1103, the value of $\Delta A_0$ determined at the step 1102 is added to the integrated value I obtained by the preceding processing of this routine and also the value of $\Delta A_5$ stored by the preceding processing of this routine is subtracted, thereby updating the integrated value I. In other words, at the step 1103, the addition of $\Delta A_0$ and the subtraction of $\Delta A_5$ are effected to calculate an integrated value I of the absolute value of the deviation $\Delta A$ between the command value CMD and the actual throttle position $\theta_s$ within the given time. At a step 1104, the integrated value I determined at the step 1103 is compared with a decision value K predetermined in accordance with the motor temperature $T_M$ detected by the temperature sensor 6*b* as shown in FIG. 12. If $I<K$, it is determined that there is no fault and a transfer is made to a step 1108. If $I \geqq K$, it is determined that there is a fault and a transfer is made to a step 1105. At the step 1105, the flag $F_B$ is again set to 1 and stored in the RAM 23. At the next step 1106, a command is applied to the output unit 25 to turn the warning lamp 15 on. At a step 1107, a command is applied to the output unit 25 to open the relay 145, thereby ending this routine.

Then, at the steps 1108 to 1113, for the following processing of the routine, the integrated value I is stored in the RAM 23 and also storing of $\Delta A_0$ as $\Delta A_1$, $\Delta A_1$ as $\Delta A_2$, $\Delta A_2$ as $\Delta A_3$, $\Delta A_3$ as $\Delta A_4$ and $\Delta A_4$ as $\Delta A_5$ in the RAM 23 are effected, thereby ending the routine.

Figure 13:
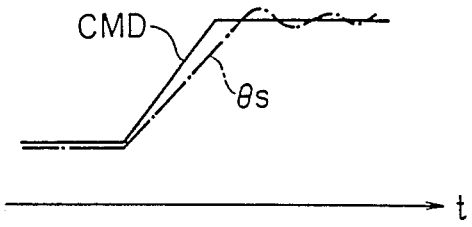
FIG. 13 is a time chart showing variations of the command value CMD and the actual throttle position $\theta_S$ during the normal operation.
Figure 14:
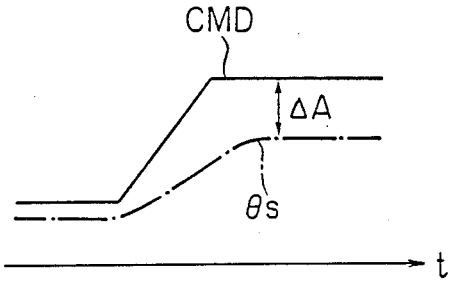
FIGS. 14, 15, 16 and 17 are time charts showing variations of the command value CMD and the actual position $\theta_S$ in the faulty conditions.
Figure 15:
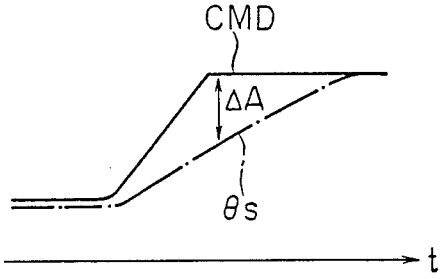
Figure 16:
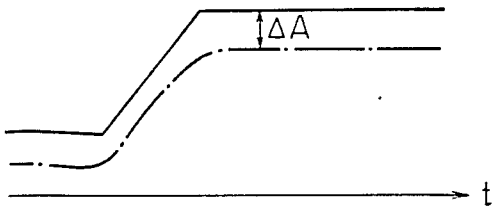

In accordance with the processing shown in FIG. 11, if, for example, the actual throttle position $\theta_s$ satisfactorily follows the command value CMD as shown in FIG. 13, the integrated value I is sufficiently smaller than the decision value K and thus it is determined that there is no fault. On the contrary, if the deviation $\Delta A$ between the command value CMD and the actual throttle position $\theta_s$ increases and continues over a long period of time, the integrated value I is greater than the decision value K and it is determined that there is a fault. Also, when the command value CMD varies greatly so that the actual throttle position $\theta_s$ fails to satisfactorily follow the former and a large deviation $\Delta A$ is caused temporarily as shown in FIG. 15, the resulting integrated value I within a given time including the large deviation becomes greater than the decision value K and it is determined that there is a fault. Further, when the actual throttle position $\theta_s$ responds to variation of the command value CMD but a deviation $\Delta A$ is caused steadily as shown in FIG. 16, the resulting integrated value I of the deviation ΔA within a given time is greater than the decision value K and it is determined that there is a fault.

Figure 17:
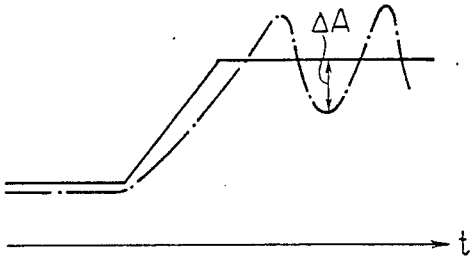

On the other hand, when the actual throttle position $\theta_s$ hunts or swings considerably on both sides of the command value CMD as shown in FIG. 17, the resulting integrated value I of the deviation ΔA within a given time is greater than the decision value K and thus it is determined that there is a fault.

Then, when it is determined that the operating condition of the throttle valve 4 is faulty in the above-mentioned manner, the warning lamp 15 is turned on and the current flow to the stepping motor 6 is stopped.

Thus, in accordance with the present embodiment, it is also possible to positively determine as faulty conditions those conditions where the operating response of the throttle valve 4 is deteriorated so that it fails to satisfactorily follow a large variation of the command value CM and where the command value CMD is maintained substantially constant but a steady-state deviation is caused between it and the actual throttle position $\theta_s$ or the position controllability of the throttle valve 4 is deteriorated thus causing it to hunt considerably. Moreover, due to the fact that the determination of a fault is made in accordance with the integrated value I of the deviation between the command value CMD and the actual throttle valve $\theta_s$ within a given time, the integrated value I reflects the deviation between the desired throttle position or the command value CMD and the actual throttle position for the given time selected for making a decision and therefore the occurrence of a fault can be detected rapidly.

On the other hand, where the movement of the stepping motor 6 is slow as during the cold starting period of the engine 1, the actual throttle position $\theta_s$ of the throttle valve 4 inevitably fails to satisfactorily follow the command value CMD and this external factor increases the integrated value I. In accordance with the present embodiment, however, it is preset so that the command value K is increased with a decrease in the motor temperature $T_M$ and thus any erroneous decision due to such external factor is prevented. It is to be noted that while, in the present embodiment, the temperature $T_M$ in the vicinity of the bearing portion of the stepping motor 6 is directly detected by the temperature sensor **6*b*, as the engine 1 warms up, the stepping motor 6** itself warms up with the resulting improvement of its movement and therefore the decision value K may be preset in correspondence to the cooling water temperature $T_W$. Also, the decision value K may be preset in correspondence to the intake air temperature $T_A$ for the same reason as mentioned above.

Figure 18:
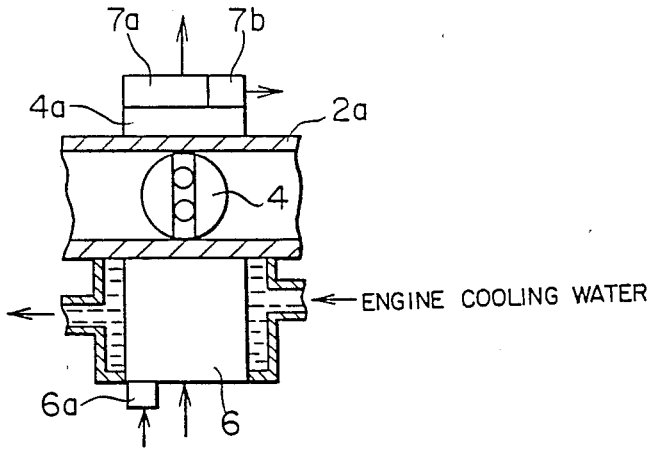
FIG. 18 shows the construction of a stepping motor section in another embodiment of the invention.

In addition, as shown in FIG. 18, the engine cooling water may be introduced around the stepping motor 6 so as to preset the decision value K in correspondence to the water temperature $T_W$ as mentioned above. By so doing, it is possible to prevent an deterioration in the operating performance of the stepping motor 6 due to its excessive cooling by the atmospheric temperature.

Moreover, where the accelerator pedal 13 is depressed rapidly so that the command value CMD is varied rapidly, a deviation is inevitably caused between the command value CMD and the actual throttle position $\theta_s$ due to a delay in the response of the stepping motor 6. Thus, such response delay may be taken into consideration to incrementally correct the decision value K in correspondence to a change in the accelerator sensor signal $V_a$. Note that since this embodiment includes the return spring **4*a* for biasing the throttle valve 4** in the fully closing direction, it is desirable to use the different correction values between the cases where the rotation is changed to the opening direction and where the rotation is changed in the closing direction so that the decision value K is corrected to have a greater value when the rotation is changed in the opening direction.

While, in the above-described embodiment, the integrated value I is determined from a total of the five deviations including the deviation produced during the execution of the interrupt routine of FIG. 11 and the preceding four deviations, this number is preset arbitrarily in accordance with the performance of the stepping motor 6, for example.

Further, while, in the above embodiment, the interrupt routine of FIG. 11 for determining a fault in the operating condition of the throttle valve 4 is executed at intervals of 50 ms, this interval of time is preset arbitrarily in accordance with the determination accuracy.

Figure 19:
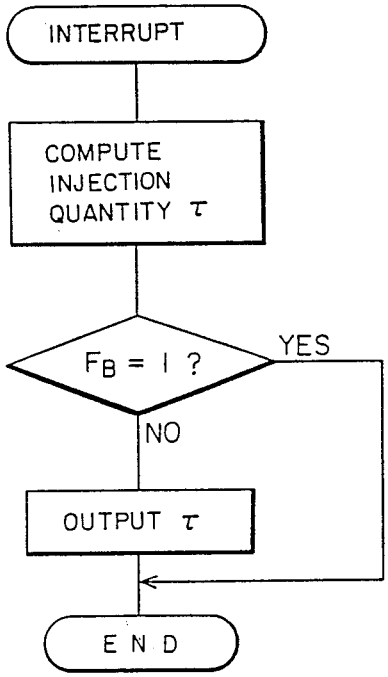
FIG. 19 is a flow chart showing a procedure for cutting off the fuel injection.

Still further, while, in the above embodiment, in response to the determination of a fault the current flow to the stepping motor 6 is stopped and the warning lamp 15 is turned on, the injection of fuel from the injectors 9 may be cut off as shown in FIG. 19 instead of stopping the current flow to the stepping motor 6. In other words, FIG. 19 shows an injection quantity computing routine which is executed in synchronism with the engine rotation so that if the flag $F_B$ is 1, the processing is completed without outputting the computed injection quantity $\tau$. Thus, no drive signal is outputted from the output unit 25 in response to the injectors 9 and the fuel injection is cut off.

On the other hand, where the idle speed control (ISC) or the traction control upon acceleration slip is performed by using the above-mentioned throttle valve 4 which is opened and closed by the stepping motor 6, the control is effected independently of the command value CMD determined by the accelerator sensor signal $V_a$ and therefore there is the danger of erroneously determining the occurrence of a faulty condition by the processing shown in FIG. 11. Thus, it is preferable to inhibit the processing shown in FIG. 11 during the execution of such speed control or traction control.

Figure 20:
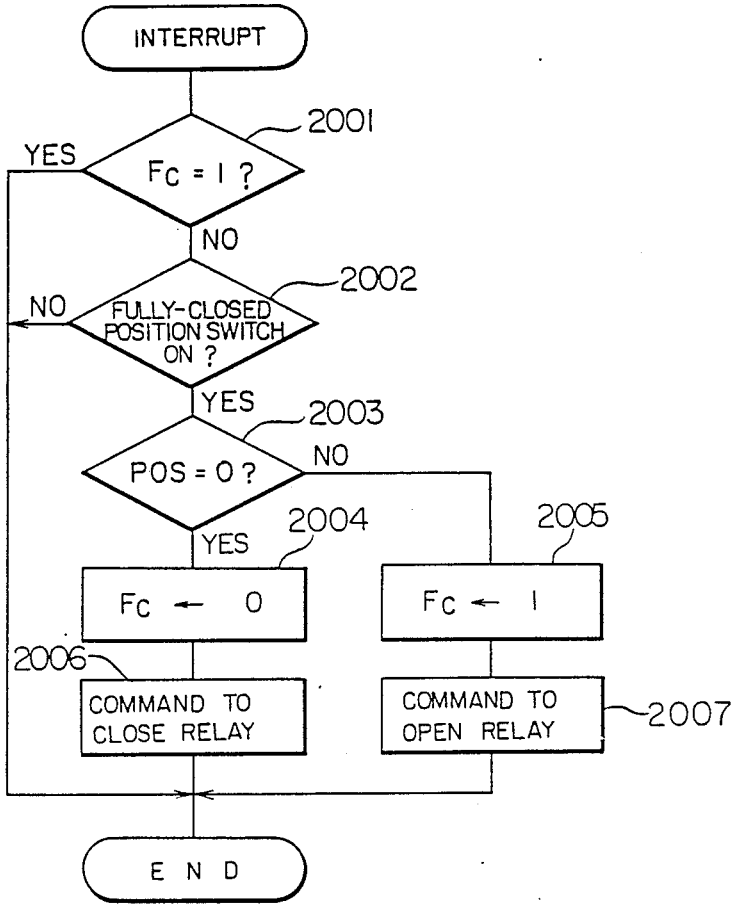
FIG. 20 is a flow chart showing a procedure for controlling the relay when a step-out condition of the stepping motor is detected.
Figure 21:
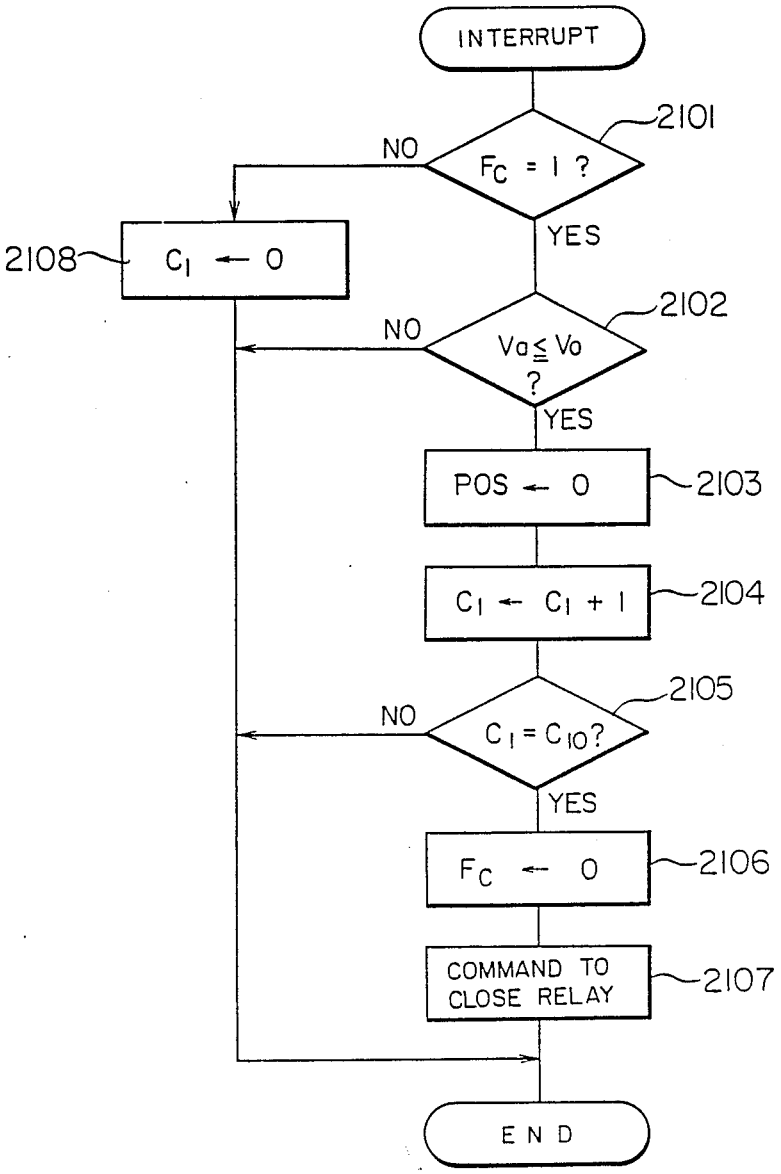
FIG. 21 is a flow chart showing a procedure for controlling the relay after the occurrence of the step-out condition of the stepping motor.

Then, the CPU 21 also executes the programs shown by the flow charts of FIGS. 20 and 21.

The program shown in FIG. 20 is an interrupt routine which is executed in response to an interruption occurring for example at intervals of 10 ms. At a step 200, a check is first made on a flag $F_c$ to determine whether the ECU 20 has generated a command to open the relay 45. If the flag $F_c$ is 1, all of the following steps are skipped and this routine is ended. If the flag $F_c$ is 0, a transfer is made to a step 2002. Note that if the flag $F_c$ is 1, it is an indication that a command for opening the relay 145 or a command to interrupt the current supply to the stepping motor 6 has been generated. If the flag $F_c$ is 0, it is an indication that a command for closing the relay 145 or a command for the current supply to the stepping has been generated.

At the step 2002, it is determined whether the fully-closed position switch **7*b* has been turned on or the throttle valve 4 is at the fully closed position. If it has been turned on, a transfer is made to a step 2003. If it has been turned off, all the following steps are skipped and the routine is ended. At the step 2003, it is determined whether the actual value POS is 0 or the amount of accelerator movement by the driver is 0 and the throttle valve 4 is controlled at the fully closed position. If POS=0, a transfer is made to a step 2004. If POS≠0, a transfer is made to a step 2005**.

In other words, despite the fact that the fully-closed position switch 7b indicative of the fully closed condition of the throttle valve 4 has been turned on at the steps 2002 and 2003, if the accelerator pedal 13 is depressed by the driver so that the actual value POS is not 0, it is determined that the rotor of the stepping motor 6 has stepped out of synchronism so that the throttle valve 4 is fully closed by the return spring 4a, and a transfer is made to the step 2005.

At the step 2004, the flag $F_c$ is set to 0 and a transfer is made to a step 2006 where a command for closing the relay 145 is applied to the output unit 25, thereby ending the routine.

At the step 2005, the flag $F_c$ is set to 1 and a transfer is made to a step 2007 where a command for opening the relay 145 is applied to the output unit 25, thereby ending the routine.

Thus, in accordance with the above-mentioned program, when the occurrence of a step-out condition is determined, a signal is applied to the relay 145 from the output unit 25 and the relay 145 is opened. When this occurs, the current supply to the stepping motor 6 is interrupted so that even if a signal is applied from the ECU 20, the stepping motor 6 does not come into operation and the fully-closed throttle condition due to the return spring 4a is maintained.

Referring to FIG. 21, the program shown is an interrupt routine which is executed at intervals of 25 ms, for example. At a step 2101, it is determined whether the flag $F_c$ is 1. If it is not, a transfer is made to a step 2108 where a counter $C_1$ which will be described later is cleared, thereby ending the routine. If the flag $F_c$ is 1, a transfer is made to a step 2102 where it is determined whether the accelerator sensor signal $V_a$ indicative of the position of the accelerator pedal 13 depressed by the driver is smaller than a value $V_o$ corresponding to the zero accelerator position, that is, whether the driver is intending to return the throttle valve 4 to the fully closed position. If $V_a \leqq 0$, a transfer is made to a step 2103. If $V_a > V_o$, all the following steps are skipped and the routine is ended.

At the step 2103, the POS is cleared to 0. At a step 2104, the counter $C_1$ for measuring the time elapsed since the time of $V_a \leqq V_o$ after the flag $F_c=1$ is incremented, and then a transfer is made to a step 2105.

At the step 2105, it is determined whether the counter $C_1$ has attained a given value $C_{10}$ (e.g., 4 or 100 ms). If the value has been attained, a transfer is made to a step 2106. If the value has not been attained, this routine is ended. At the step 2106, the flag $F_c$ is set to 0 and a transfer is made to a step 2107 where a command for closing the relay 145 is applied to the output unit 25, thereby ending the routine.

In other words, in accordance with the program of FIG. 21, if the condition where the flag $F_c$ is 1 and $V_a \leqq V_o$ continues 100 ms, the signal applied from the output unit 25 to the relay 145 to open it is applied no longer so that the relay 145 is closed and the current supply to the stepping motor 6 is restored.

Figure 22:
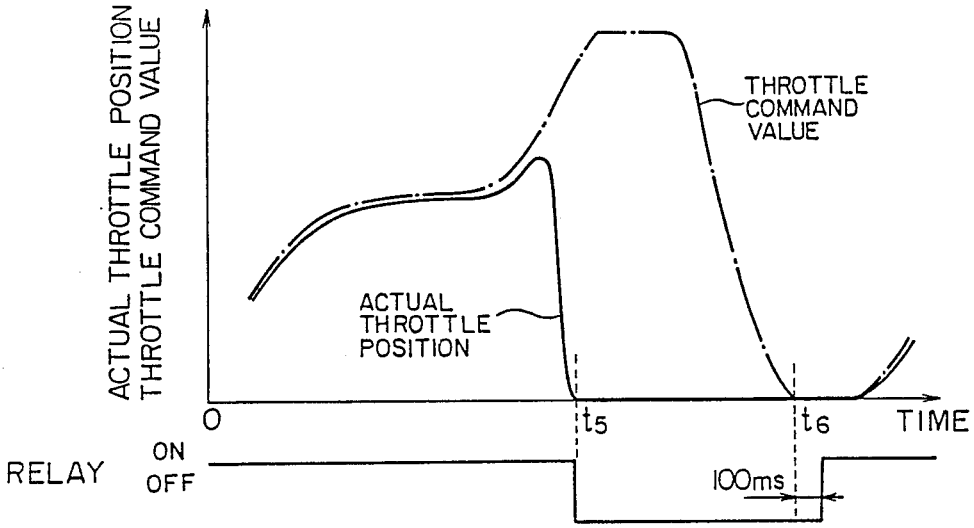
FIG. 22 is a time chart showing variations of the command value CMD and the actual throttle position $\theta_S$ under the step-out condition in accordance with the flow charts of FIGS. 20 ad 21.

In accordance with the programs shown in FIGS. 20 and 21, as shown by the time chart of FIG. 22, when the throttle valve 4 is fully closed at a time $t_5$ due to the stepping motor 6 stepping out of synchronism, the relay 145 is opened so that the current supply to the stepping motor 6 is interrupted and the stepping motor 6 is brought out of operation, thereby maintaining the throttle valve 4 in the fully closed condition due to the biasing force of the return spring 4a. Then, when the command value CMD for the throttle valve 4, corresponding to the accelerator sensor signal $V_a$ of the accelerator pedal 13 depressed by the driver, becomes 0 at a time $t_6$ and this condition is maintained for 100 ms, the relay 145 is again closed and the current flow to the stepping motor 6 is restored, thereby returning the stepping motor 6 to the normal operation.

Figure 23:
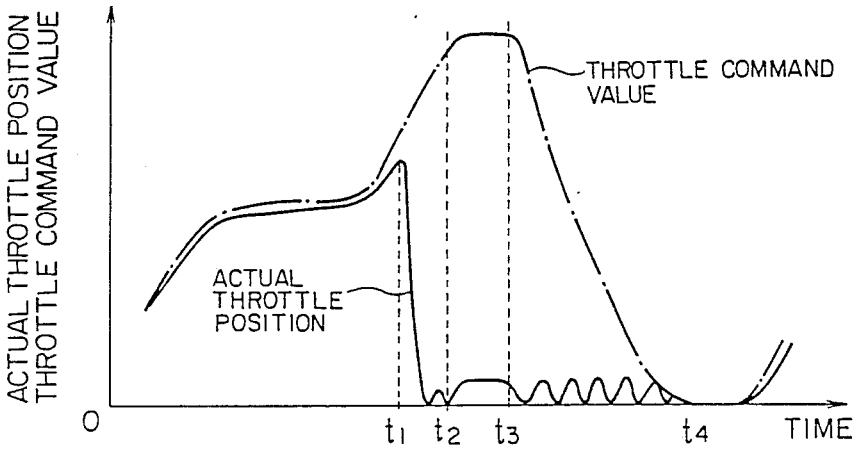
FIG. 23 PRIOR ART
FIG. 23 is a time chart showing variations of the command value CMD and the actual throttle position $\theta_S$ under the step-out condition in the conventional construction.

Referring to FIG. 23, there is illustrated a time chart for a conventional apparatus which does not incorporate the above-mentioned construction. In the Figure, when, at a time $t_1$, the stepping motor fails to operate the throttle valve to follow the command value for the throttle valve corresponding to the depression of the accelerator valve by the driver and the stepping motor steps out of synchronism, the throttle valve is immediately returned to the fully closed position by the biasing force of the return spring. Then, if the behavior of the throttle valve settles down at a time $t_2$ and the command value starts to rise further at the time $t_2$, the throttle valve is opened in proportion to the increase in the command value from that time on. When a time $t_3$ is reached so that the driver releases the accelerator pedal, the stepping motor closes the throttle valve. However, even after the throttle valve has been returned to the fully closed position, the stepping motor tends to rotate the throttle valve to the fully closed position side in response to the command of the ECU so that each time the stepping motor makes a stepping movement, the throttle valve strikes against the fully-closed position stopper for the throttle valve and throttle valve is opened by the reaction. This pulsating movement of the throttle valve continues until the command value is reduced to zero.

As the result of such pulsating movement of the throttle valve, the engine rotation is caused to pulsate so that if the clutch is in engagement, the vehicle is caused to make a shaky running irrespective of the driver's will.

With the above-described construction of the embodiment, however, even if the stepping motor 6 steps out of synchronism so that the throttle valve 4 is returned to the fully closed position, the current supply to the stepping motor 6 is interrupted by the ECU 20 from that time on and also the current supply to the stepping motor 6 is resumed by the ECU 20 after the complete release of the accelerator pedal has been confirmed. As a result, there is the effect of eliminating any irregular movement of the throttle valve 4 due to malfunctioning of the stepping motor 6 after it has stepped out of synchronism and the above-mentioned problems are solved altogether, thereby enhancing the safety remarkably.

While the above-described construction is applied to a case in which the preceding actual value POS of the stepping motor 6 is stored and the deviation between this and the one obtained by the depression of the accelerator pedal is obtained thereby subjecting it to a closed loop control, the present construction is also applicable to another case in which the actual position of the throttle valve 4 is detected by the throttle position sensor 7a and the deviation between it and the desired throttle position determined in accordance with the accelerator pedal position or the like is obtained, thereby subjecting it to a closed loop control.

Also, while, in the above construction, the determination of a step-out condition is effected in such a manner that the occurrence of a step-out condition is determined when the fully-closed position switch 7b is ON and POS≠0, instead of making the determination on the basis of POS, it is possible to make the determination depending on whether the accelerator sensor signal $V_a$ is smaller than $V_o$. In this case, the occurrence of a step-out condition is determined when the fully-closed position switch 7b is ON and the accelerator sensor signal $V_a > V_o$.

Further, while the relay 145 is provided to switch on and off the current flow to the stepping motor 6, the relay 145 may be replaced with any other switching element such as a power transistor.

Figure 24:
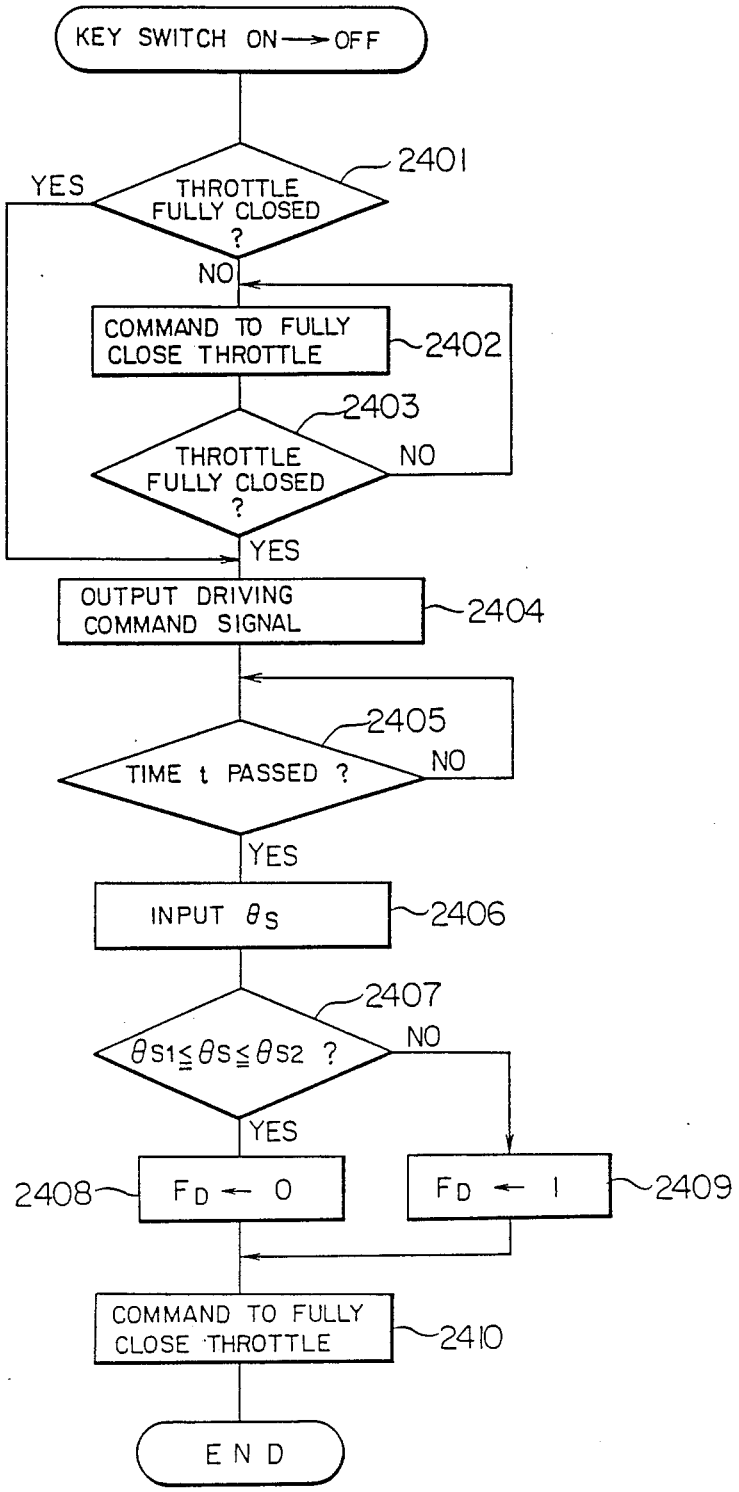
FIG. 24 is a flow chart showing a procedure for predicting a fault in the apparatus of the invention.

Referring now to FIG. 24, there is, illustrated a flow chart of a program for predicting a fault in the driving system of the throttle valve 4 and its execution is started when the key switch 142 is switched from the ON to the OFF state.

It is to be noted that as mentioned previously, even if the key switch 142 is turned off, the power is supplied to the ECU 20 from the delay circuit 144 through the current supply line 143 and therefore the processing of the CPU 21 can be continued. It is also arranged so that the power is supplied from the battery 14 through the current supply line 143 and the delay circuit 144 to the stepping motor 6 which operates the throttle valve 4.

Figure 25:
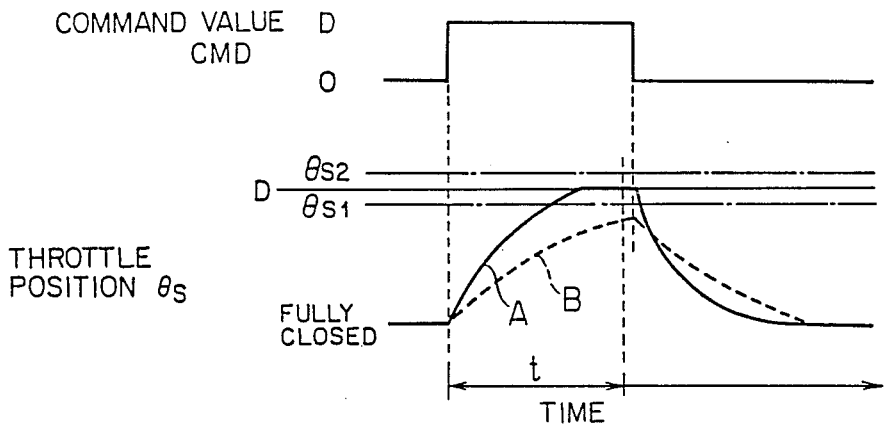
FIG. 25 is a time chart showing the movement of the throttle valve according to the flow chart shown in FIG. 24.

In FIG. 24, at a step 2401, it is determined whether the throttle valve 4 is in the fully closed condition in accordance with the signal from the throttle position sensor 7a. If it is, a transfer is made to a step 2404. If it is not, a transfer is made to a step 2402. At the step 2402, a command for fully closing the throttle valve 4 is applied to the output unit 25. At a step 2403, it is determined whether the throttle valve 4 is at the fully closed position. At the step 2404, the command value CMD =D as shown in FIG. 25 is set and a driving command signal is applied to the stepping motor 6 such that the actual position of the throttle valve 4 attains the value of D by the processing of FIG. 8. At a step 2405, it is determined whether a given time t has expired after the generation of the command signal. If it is YES, a transfer is made to a step 2406. At the step 2406, the throttle position signal $\theta_s$ detected at that time by the throttle position sensor 7a is inputted. At the next step 2407, it is determined whether the current throttle position is within a throttle position range obtained by defining a tolerance for the command value CMD=D. If $\theta_{s1} \leqq \theta_s \leqq \theta_{s2}$, a transfer is made to a step 2408. If it is not the case, a transfer is made to a step 2409. Here, $\theta_{s1}$ represents the lower limit of the throttle position range and $\theta_{s2}$ represents the upper limit of the throttle position range.

At the step 2408, a flag $F_D$ stored in the RAM 23 for showing a premonition of a fault in the driving system of the throttle valve 4 is set to 0 and a transfer is made to a step 2410. At the step 2409, the flag $F_D$ is set to 1 and a transfer is made to the step 2410. At the step 2410, a fully-closed position command is applied to the output unit 25 to fully close the throttle valve 4 and the routine is ended.

In other words, in accordance with the processing shown in FIG. 24, it is determined whether the throttle valve 4 is opened to the position corresponding to the command value CMD=D before the passage of the given time t. Specifically, the processing of FIG. 24 monitors the response of the throttle valve 4 in operation. Then, if the throttle position attains the given position within the given time t as shown by the solid line A in FIG. 25, that is, the operating response of the throttle valve 4 is within a given tolerance, it is determined that there is no fault and moreover there is no danger of any fault being caused in the driving system of the throttle valve 4 for some time. On the contrary, if the throttle position fails to attain the given position as shown by the broken line B, that is, the operating response of the throttle valve 4 has been deteriorated, it is determined that the frictional force in the bearing portion of the throttle valve 4 or within the stepping motor 6 has increased due to the aging and there is the danger of the throttle valve 4 or the stepping motor 6 being locked. These conditions are stored and maintained in terms of the states of the flag $F_D$. It is to be noted that the given time t is predetermined in accordance with the response based on the initial characteristics of the driving system for the throttle valve 4 by making allowance for a change of the tolerance with time.

Figure 26:
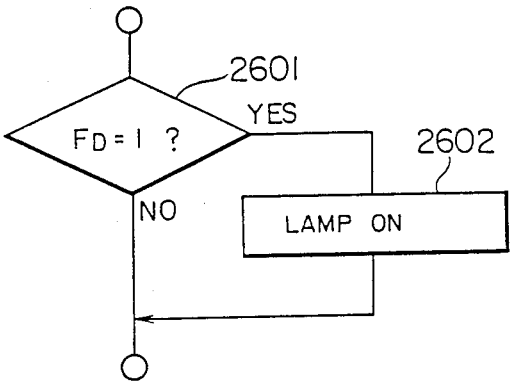
FIG. 26 is a flow chart showing a procedure performed as a part of the initialize step in the flow chart shown in FIG. 4.

Referring to FIG. 26, there is illustrated a flow chart of a program which is executed as a part of the initialization process of the step 410 in FIG. 4. At a step 2601, it is determined whether the flag FD in the RAM 23 is 1. If it is, a transfer is made to a step 2602. If it is not, this routine is ended and a transfer is made to the next processing. At the step 2602, a command for turning the warning lamp 15 on is applied to the output unit 25 so as to turn the warning lamp 15 on and inform the driver of the fact that there is the danger of a fault being caused in the driving system of the throttle valve 4, and then a transfer is made to the next processing.

In accordance with this construction, in the processing shown in FIG. 24 the operating response of the throttle valve 4 is monitored so that when there is a deterioration of the response beyond the tolerance, it is determined that there is an increasing danger of a fault being caused in the driving system of the throttle valve 4 so that before the occurrence of a fault in the driving system of the throttle valve 4, the driver is informed of the danger of such fault and the throttle valve 4 or the stepping motor 6 is prevented from being looked during the running.

Figure 27:
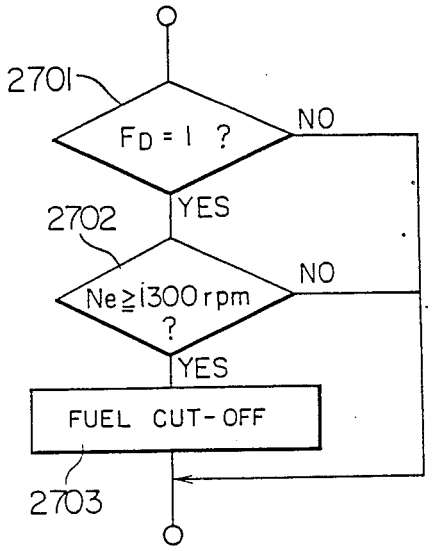
FIG. 27 is a flow chart showing a part of a procedure for controlling the fuel injection.

In this connection, even in the condition where the driver is informed of the danger of a fault by the warning lamp 15, actually the vehicle can be driven and it is conceivable that the driver runs the vehicle to a repair shop. Then, it is dangerous if such looking occurs during the running and therefore the fuel injection control processing shown in FIG. 27 is designed so that at steps 2701 to 2703, the fuel injection is cut off when the flag $F_D$ is 1 and the engine speed $N_I$ is higher than 1300 rpm, thereby maintaining a safe condition even such looking is caused during the running.

While, in the above construction, the operating response of the throttle valve 4 is monitored upon switching from the ON to the OFF state of the key switch 142, the monitoring may be effected when the fuel is cut off.

Figure 28:
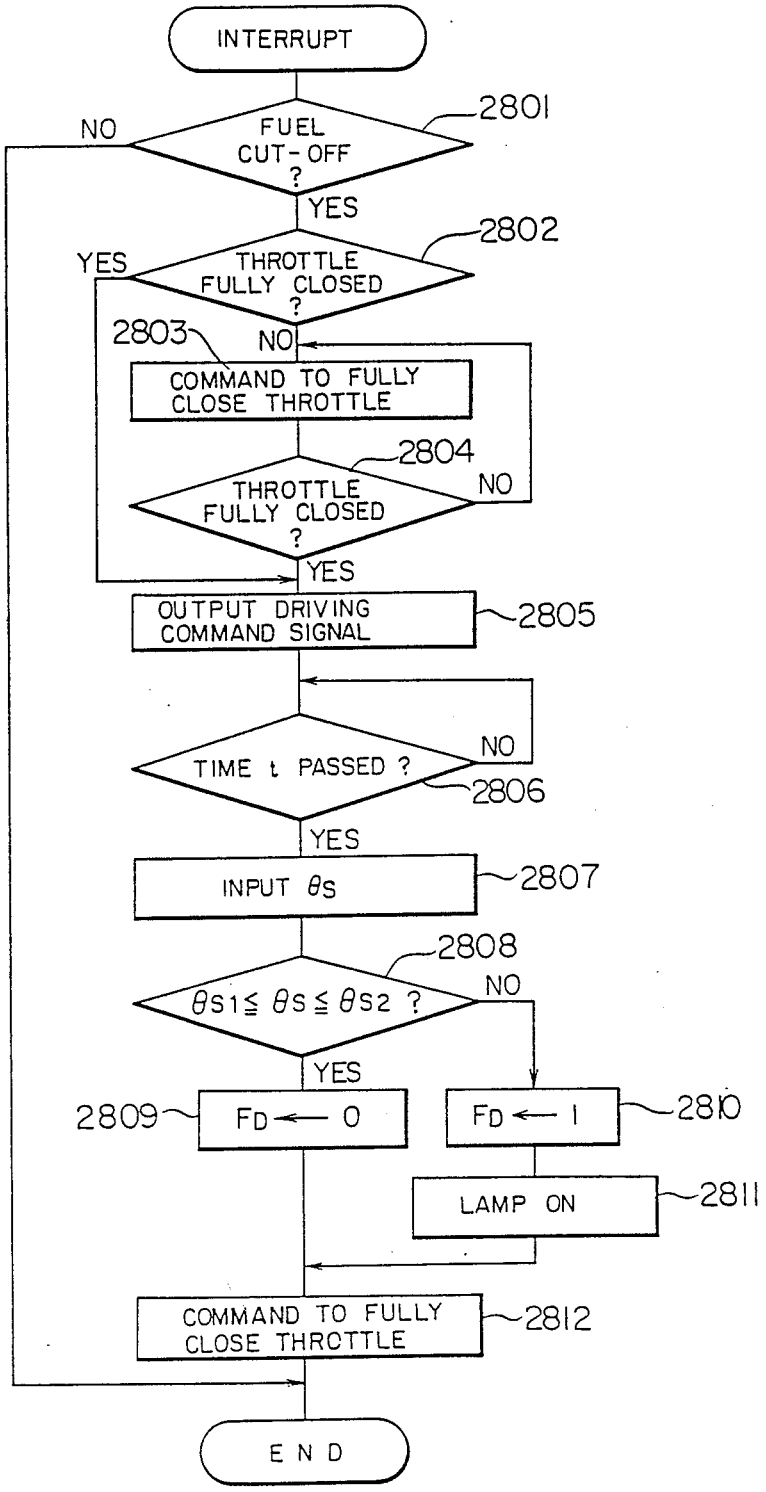
FIG. 28 is a flow chart showing another example of the procedure for predicting a fault in the apparatus according to the present invention.

FIG. 28 shows a flow chart of a processing program for such a case and it is executed as an interrupt routine at intervals of 40 ms. Firstly, at a step 2801, it is determined whether the fuel has been cut off. If the fuel has been cut off, the same processing as the steps 2401 to 2409 of FIG. 24 is performed at steps 2802 to 2810. Then, at a step 2811, a command is applied to the output unit 25 to turn the warning lamp 15 on. At a step 2812, a command is applied to the output unit 25 to fully close the throttle valve 4.

While, in the above-described construction, whether the operating response of the throttle valve 4 is within the tolerance is determined from the throttle position $\theta_s$ attained at the time of expiration of the given time t, it is possible to determine the response in a manner that after a command has been applied to open the throttle valve 4 to a given position, the time required to attain the given position is measured to determine whether the measured time is within a tolerance.

Figure 29:
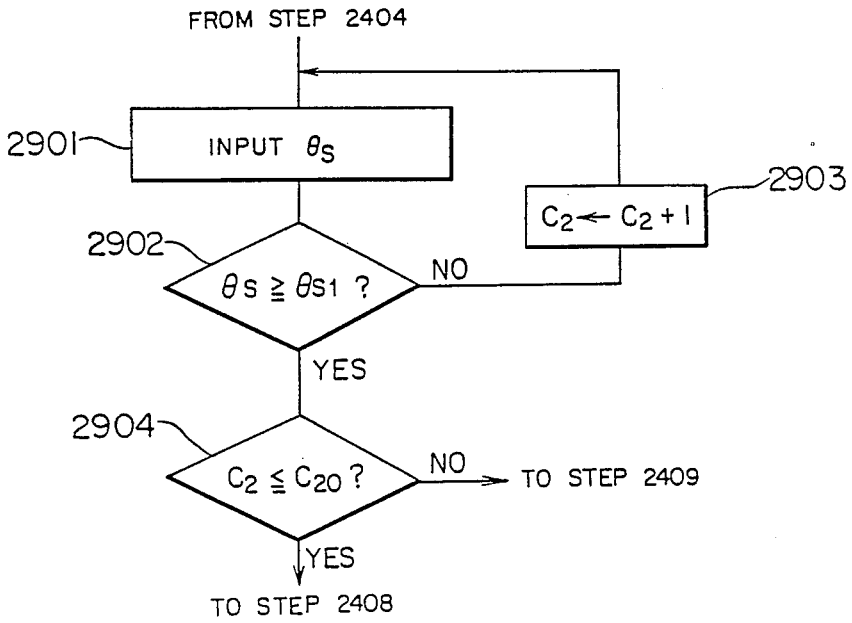
FIG. 29 is a flow chart showing still another example of the procedure for predicting a fault in the apparatus according to the present invention.

FIG. 29 shows a specific example of this process as a part of the processing of FIG. 24. After the driving command signal outputting operation at the step 2404, whether the throttle position $\theta_s$ is above the lower limit $\theta_{s1}$ of the throttle position range shown in FIG. 25 is determined at a step 2902. If it is not, a counter $C_2$ is incremented at a step 2903 and a return is made to the step 2901. If the throttle position $\theta_s$ is above the lower limit $\theta_{s1}$, a transfer is made to a step 2904 where the content of the counter $C_2$ is compared with a comparison value $C_{20}$ determined by making allowance for an allowable change with time of the initial characteristic of the driving system for the throttle valve 4. If $C_2 \leqq C_{20}$, a transfer is made to the step 2408. If $C_2 > C_{20}$, a transfer is made to the step 2409. Note that the counter $C_2$ is cleared at a step following the step 2904 and not shown.

It is to be noted that in the processing shown in FIG. 29, a step for determining whether $C_2 \geqq C_{21}$ ($C_{21} > C_{20}$) may be added in the return flow line from the step 2903 to the step 2901 so that a transfer is made to the step 2409 when $C_2 \geqq C_{21}$ and a transfer is made to the step 2901 when $C_2 < C_{21}$. By so doing, it is possible to eliminate any undesired repetitive processing of the step 2901→step 2902→step 2903→step 2901.

Also, in order to determine the operating response of the throttle valve 4, it is possible to trace the position response waveform of the throttle valve 4 generated by the application to the stepping motor 6 of a driving command signal corresponding to the command value CMD=D as shown in FIG. 25 so that a time constant of the transfer function between the throttle position command value and the throttle position from the response waveform thereby setting the flag $F_D$ to 0 when the time constant is smaller than a given value and setting the flag $F_D$ to 1 when the time constant is greater than the given value.

While, in the embodiments described above, the rotation of the stepping motor 6 is transmitted to the shaft of the throttle valve 4 to adjust the position of the throttle valve 4, the constructions of the embodiments may be partly modified as shown in JP-A-59-20539 so that the stepping motor 6 includes a rod movable to advance or retreat in response to a drive signal from the ECU 20 and the throttle valve 4 includes a lever adapted to contact with the rod, thereby adjusting the position of the throttle valve 4 in accordance with the movement of the rod.

We claim:

1. A throttle valve control apparatus comprising:

a throttle valve for adjusting the amount of air drawn into an internal combustion engine;

control parameter detecting means for detecting a control parameter for controlling a position of said throttle valve;

a stepping motor for operating said throttle valve to a given position;

a return spring for applying to said throttle valve a force tending to close the same;

throttle valve position commanding means responsive to a control parameter detected by said control parameter detecting means to generate a command signal for bringing said throttle valve to a given position;

stepping motor driving means responsive to the command signal from said throttle valve position commanding means to drive said stepping motor;

throttle valve acceleration/deceleration detecting means for detecting at least one of an acceleration in a direction tending to open said throttle valve and a deceleration in a direction tending to close said throttle valve; and current varying means for increasing a driving current to said stepping motor when said throttle valve acceleration/deceleration detecting means detects at least one of an acceleration in said throttle valve opening direction and a deceleration in said throttle valve closing direction.

2. An apparatus according to claim 1, wherein said control parameter detecting means comprises an accelerator sensor for detecting a position of an accelerator pedal depressed by a driver.

3. An apparatus according to claim 1, wherein said throttle valve acceleration/deceleration detecting means detects at least one of an acceleration in said throttle valve opening direction and a deceleration in said throttle valve closing direction in accordance with the command signal from said throttle valve position commanding means.

4. An apparatus according to claim 1, wherein said throttle valve position commanding means includes desired throttle position setting means responsive to said control parameter to set a desired position for said throttle valve and output said desired position as said command signal.

5. An apparatus according to claim 4, further comprising actual position detecting means for detecting an actual position of said throttle valve, and deviation computing means for determining a deviation between the desired position set by said desired throttle position setting means and the actual position detected by said actual position detecting means, whereby in accordance with said deviation said throttle valve acceleration/deceleration detecting means detects at least one of an acceleration in said throttle valve opening direction and a deceleration in said throttle valve closing direction.

6. An apparatus according to claim 5, further comprising driving direction discrimination means for determining a direction of rotation of said throttle valve in accordance with a relation between said desired throttle position and said actual position.

7. An apparatus according to claim 4, further comprising actual position detecting means for detecting an actual position of said throttle valve, wherein said stepping motor driving means includes rotational direction discrimination means for determining a direction of rotation of said throttle valve in accordance with a relation between said desired throttle position and said actual position, deviation detecting means for determining a deviation between said desired throttle position and said actual throttle position, rotational speed setting means for setting a rotational speed of said throttle valve in accordance with said deviation, and signal output means for applying to said stepping motor a driving command signal in accordance with said rotational direction determined by said rotational direction discrimination means and said rotational speed set by said rotational speed setting means, and wherein said throttle valve acceleration/deceleration detecting means detects at least one of an acceleration in said throttle valve opening direction and a deceleration in said throttle valve closing direction in accordance with said rotational direction determined by said rotational direction discrimination means and said rotational speed set by said rotational speed setting means.

8. An apparatus according to claim 2, further comprising accelerator sensor fault detecting means for detecting a fault in said accelerator sensor.

9. An apparatus according to claim 8, further comprising operating condition detecting means for directly detecting that said accelerator pedal is being depressed by said driver, and wherein said accelerator sensor fault detecting means detects a fault in said accelerator sensor in accordance with an output of said accelerator sensor and an output of said operating condition detecting means.

10. An apparatus according to claim 9, wherein when said accelerator sensor fault detecting means detects a fault in said accelerator sensor, said throttle valve position commanding means generates said command signal in accordance with an output of said operating condition detecting means.

11. An apparatus according to claim 1, further comprising step-out determining means for determining a step-out condition of said stepping motor, and current cut-off means for cutting off the supply of current to said stepping motor when said step-out detecting means determines that said stepping motor is in a step-out condition.

12. An apparatus according to claim 11, further comprising current supply restoring means for releasing the current cut-off to said stepping motor by said current cut-off means when said throttle valve position commanding means generates a command signal to fully close said throttle valve.

13. An apparatus according to claim 1, further comprising actual position detecting means for detecting an actual position of said throttle valve, monitor means for monitoring a position changing response of said throttle valve to said stepping motor driven by said stepping motor driving means in accordance with the actual position of said throttle valve detected by said actual position detecting means, and fault predicting means for predicting a fault in a driving system said throttle valve in accordance with said response monitored by said monitor means.

14. An apparatus according to claim 4, further comprising actual position detecting means for detecting an actual position of said throttle valve, deviation detecting means for computing an absolute value of a deviation between said desired throttle position and said actual position, integrated value computing means for computing an integrated valve by integrating the absolute value of said deviation over a given interval of time, and fault decision means for comparing said integrated value with a predetermined decision value to determine the occurrence of a fault when said integrated value is greater than said decision value.

15. An apparatus according to claim 14, further comprising temperature detecting means for detecting a temperature of either one of said engine and said stepping motor, and decision value setting means for setting said decision value in accordance with the temperature detected by said temperature detecting means.

16. An apparatus according to claim 14, further comprising warning means responsive to the determination of a fault by said fault decision means to inform said driver of the occurrence of said fault.

17. An apparatus according to claim 14, further comprising current cut-off means responsive to the determination of a fault by said fault decision means to cut off the supply of current to said stepping motor.

18. A throttle valve control apparatus comprising:

a throttle valve for adjusting the amount of air drawn into an engine;

an actuator for operating said throttle valve;

throttle position detecting means for detecting a position of said throttle valve;

commanding means for applying a command signal to said actuator to operate said throttle valve through said actuator;

monitor means for monitoring a position changing response of said throttle valve to said command signal from said commanding means in accordance with the throttle valve position detected by said throttle position detecting means; and fault predicting means responsive to the response of said throttle valve monitored by said monitor means to predict a fault in the operation of said throttle valve.

19. An apparatus according to claim 18, wherein said actuator is a stepping motor.

20. An apparatus according to claim 19, wherein a rotary shaft of said stepping motor is coupled to a shaft of said throttle valve.

21. An apparatus according to claim 19, wherein a rod is connected between said stepping motor and said throttle valve whereby a rotary movement of said stepping motor is converted to an advancing or retreating movement to adjust the position of said throttle valve.

22. An apparatus according to claim 18, wherein said monitor means includes a delay circuit whereby after a key switch has been turned off, said monitor means performs a monitoring operation by a power supplied through said delay circuit.

23. An apparatus according to claim 22, wherein the power delivered from said delay circuit is also supplied to said actuator.

24. An apparatus according to claim 18, wherein said monitor means includes means for determining whether said throttle valve is at a fully closed position, and means for determining whether said throttle valve attains a given actual position within a given time when a drive signal is applied to move said throttle valve from said fully closed position to said given position.

25. An apparatus according to claim 24, wherein a tolerance is established for said given position whereby the occurrence of no fault is determined when the position of said throttle valve is within said tolerance, and the occurrence of a fault is determined when the position of said throttle valve is beyond said tolerance.

26. An apparatus according to claim 24, wherein a tolerance is established for said given time whereby the response of said throttle valve is monitored in dependence on whether a time required for attaining said given actual position is within said tolerance.

27. An apparatus according to claim 18, wherein said monitor means performs a monitoring operation during a period of fuel cut-off.

28. An apparatus according to claim 18, wherein said fault predicting means includes a warning lamp for informing the driver of the occurrence of a fault.

29. An apparatus according to claim 18, further comprising fuel cut-off means whereby during the period of vehicle running where the occurrence of a fault in the driving system of said throttle valve is determined, the supply of fuel to said engine is cut off when the speed thereof is higher than a given rotational speed.

30. A throttle valve control apparatus comprising:

a throttle valve for adjusting the amount of air drawn into an engine mounted on a vehicle;

an actuator for operating said throttle valve;

throttle position detecting means for detecting an actual position of said throttle valve;

operating condition detecting mean for detecting operating conditions of said vehicle and said engine;

throttle position setting means responsive to an operating condition detected by said operating condition detecting means to set a desired throttle position for said throttle valve;

driving signal output means for applying to said actuator a driving signal corresponding to said desired throttle position of said throttle valve set by said throttle position setting means;

deviation computing means for determining a deviation between the actual throttle position of said throttle valve detected by said throttle position detecting means and the desired throttle position of said throttle valve set by said throttle position setting means;

integrated value computing means for determining an integrated value of said deviation determined by said deviation computing means over a given interval of time; and decision means for determining the occurrence of a fault when said integrated value determined by said integrated value computing means is greater than a predetermined decision value.

31. An apparatus according to claim 30, wherein said actuator is a stepping motor.

32. An apparatus according to claim 30, wherein said operating condition detecting means includes an accelerator sensor for detecting a depressed position of an accelerator pedal.

33. An apparatus according to claim 30, wherein said operating condition detecting means includes a temperature sensor for detecting a temperature of said vehicle to vary said decision value of said decision means in accordance with said detected temperature.

34. An apparatus according to claim 33, wherein said decision value is increased when said detected temperature is low.

35. An apparatus according to claim 33, wherein said temperature sensor detects a temperature of said actuator.

36. An apparatus according to claim 33, wherein said temperature sensor detects a temperature of a cooling water of said engine.

37. An apparatus according to claim 33, wherein said temperature sensor detects an intake air temperature.

38. An apparatus according to claim 30, further comprising a warning lamp whereby said warning lamp is turned on when said decision means determines the occurrence of a fault.

39. An apparatus according to claim 30, further comprising means for cutting off the supply of current to said actuator whereby said current cut-off means is brought into operation when said decision means determines the occurrence of a fault.

40. An apparatus according to claim 30, wherein said integrated value computing means determines the integrated value on the basis of an absolute value of said deviation.

41. A throttle valve control apparatus comprising:

a throttle valve for adjusting an amount of air drawn into an engine;

a stepping motor coupled to said throttle valve for adjusting a position of said throttle valve;

a power source for supplying a current to said stepping motor;

a switch arranged between said stepping motor and said power source to selectively switch on and off said current to said stepping motor;

a return spring for biasing said throttle valve into a fully closed direction;

accelerator position detecting means for detecting a position of an accelerator pedal actuated by a driver;

fully closed position detecting means for detecting that said throttle valve is in said fully closed position; and computer means, responsive to said accelerator position detected by said accelerator position detecting means, for controlling said stepping motor, said computing means including:

(a) setting means for setting a desired position of said throttle valve responsive to the accelerator position detected by said accelerator position detecting means;

(b) signal output means for applying a command signal to said stepping motor corresponding to the desired throttle position set by said setting means;

(c) step-out determining means for determining that said stepping motor is in a step-out condition when said stepping motor is controlled by the output of said signal output means such that said throttle valve is controlled to be in a position other than the fully closed position, and said fully closed position detecting means detects that said throttle valve is in said fully closed position; and (d) cut-off command means for applying to said switch a command signal for cutting off the flow of current to said stepping motor when said step-out determining means determines that said stepping motor is in said step-out condition.

42. An apparatus according to claim 41, wherein said fully closed position detecting means comprises a fully-closed position switch adapted to be turned on when said throttle valve is fully closed.

43. An apparatus according to claim 42, wherein said step-out determining means comprises counting means for performing count up and count down operations corresponding to commands in closing and opening directions of said throttle valve respectively, said step out determining means determining said step-out condition of said stepping motor when said fully-closed position switch is turned on and the actual position of said throttle valve given as a counted number in the counting means is not zero.

44. An apparatus according to claim 41, wherein said switch is a relay.

45. An apparatus according to claim 41, further comprising timer means for counting a time during a period of holding the accelerator pedal to the zero position when said step-out determining means detects the step-out condition, and restoring means for turning said switch on when the time counted by said timer means is more than a predetermined value.

46. An apparatus according to claim 41, wherein said computing means further includes counter means for counting up when said signal output means applies a command signal to said stepping motor which commands said throttle valve to be moved toward the direction of its opened position by a predetermined amount, and counting down when said signal output means applies the command signal for said stepping motor so that said throttle valve is moved toward the direction of its closed position by a predetermined amount, whereby said step-out determining means determines that said stepping motor is in the step-out condition when said fully closed position detecting means detects that said throttle valve is in the fully closed position and the value counted by said counter means is not the predetermined value.

47. An apparatus according to claim 46, wherein the value counted by said counter means is zero when said stepping motor is controlled by said signal output means so that said throttle valve is at fully closed position, and said step-out determining means determines that said stepping motor is in the step-out condition when said fully closed position detecting means detects that said throttle valve is at the fully closed position and the value counted by said counter means is not zero.

48. An apparatus according to claim 41, wherein said step-out determining means determines that said stepping motor is in the step-out condition when the accelerator position detected by said accelerator position detecting means is beyond a predetermined position, and said fully closed position detecting means detects that said throttle valve is at the fully closed position.

49. A throttle valve control apparatus comprising:

a throttle valve for adjusting the amount of air drawn into an engine mounted on a vehicle;

an actuator for operating said throttle valve;

accelerator position detecting means for detecting a position of an accelerator pedal depressed by a driver;

operating condition detecting means for directly detecting that said accelerator pedal is being depressed;

first setting means responsive to the accelerator position detected by said accelerator position detecting means to set a desired position of said throttle valve;

driving signal output means for applying to said actuator a driving signal corresponding to the desired throttle position set by said first setting means;

fault detecting means for comparing the accelerator position detected by said accelerator position detecting means and an output from said operating condition detecting means to detect a fault in said accelerator position detecting means; and second setting means to set another desired throttle position in accordance with an output from said operating condition detecting means when a fault is detected by said fault detecting means.

50. An apparatus according to claim 49, wherein said accelerator position detecting means comprises an accelerator sensor adapted to generate a voltage signal corresponding to a position of said accelerator pedal.

51. An apparatus according to claim 49, wherein said operating condition detecting means comprises an accelerator pedal switch for generating an ON-state signal or OFF-state signal.

52. An apparatus according to claim 49, wherein said desired throttle valve position set by said first setting means is proportional to said detected accelerator position.

53. An apparatus according to claim 49, wherein said fault detecting means determines the occurrence of a fault when the accelerator position detected by said accelerator position detecting means is outside a predetermined range.

54. An apparatus according to claim 49, wherein said fault detecting means determines the occurrence of a fault when the accelerator position detected by said accelerator position detecting means is not in agreement with a non-operated accelerator condition detected by said operating condition detecting means.

55. An apparatus according to claim 49, wherein said second setting means includes substitute value computing means for setting a desired throttle position in the form of a substitute value.

56. An apparatus according to claim 55, wherein the desired throttle position computed by said substitute value computing means is varied in value in accordance with an output of said operating condition detecting means.

* * * * *